US007363768B2

(12) United States Patent
Fuchikami et al.

(10) Patent No.: US 7,363,768 B2
(45) Date of Patent: Apr. 29, 2008

(54) OUTDOOR UNIT OF REFRIGERATOR, AND ELECTRICAL EQUIPMENT BOX OF OUTDOOR UNIT

(75) Inventors: Hiroshi Fuchikami, Sakai (JP); Hiroki Ishihara, Sakai (JP); Tadashi Sao, Sakai (JP); Toshiaki Mukaidani, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 390 days.

(21) Appl. No.: 10/503,219

(22) PCT Filed: Oct. 27, 2003

(86) PCT No.: PCT/JP03/13740

§ 371 (c)(1),
(2), (4) Date: Aug. 3, 2004

(87) PCT Pub. No.: WO2004/042287

PCT Pub. Date: May 21, 2004

(65) Prior Publication Data

US 2005/0144975 A1 Jul. 7, 2005

(30) Foreign Application Priority Data

Nov. 5, 2002 (JP) ..... 2002-321001
Nov. 5, 2002 (JP) ..... 2002-321002
Nov. 5, 2002 (JP) ..... 2002-321374

(51) Int. Cl.
*F25D 23/12* (2006.01)
*F25B 39/04* (2006.01)

(52) U.S. Cl. ..... 62/259.2; 62/507; 62/508

(58) Field of Classification Search ..... 62/259.2, 62/507, 508, 298
See application file for complete search history.

(56) References Cited

U.S. PATENT DOCUMENTS 4,261,418 A * 4/1981 Helt et al. ..... 165/134.1
4,390,059 A * 6/1983 Haas et al. ..... 165/76
5,097,678 A 3/1992 Aubuchon
6,320,776 B1 * 11/2001 Kajiura et al. ..... 363/141

(Continued)

FOREIGN PATENT DOCUMENTS

EP 0 922 911 A2 6/1999

(Continued)

*Primary Examiner*—William C. Doerrler
(74) *Attorney, Agent, or Firm*—Global IP Counselors, LLP

(57) ABSTRACT

The present invention reduces the size of an outdoor refrigerator unit of the type that draws in air from a lateral face, exchanges heat with the air, and blows the air out of a top face while ensuring that the electrical equipment box has sufficient volume and suppressing the increase in the air flow resistance. The air conditioning system outdoor unit is of the type that draws in air from air inlets provided in the rear panel and a pair of side panels of a casing, exchanges heat with the air, and blows the air out through an air outlet provided in a top panel. The outdoor unit is provided with an axial fan and an electrical equipment box arranged inside the casing. The electrical equipment box is arranged inside the casing and has a first box part that is provided below the axial fan and a second box part that is provided below the first box part and has a larger surface area in a plan view than the first box part.

18 Claims, 13 Drawing Sheets

U.S. PATENT DOCUMENTS 6,704,202 B1 * 3/2004 Hamaoka et al. ..... 361/704

FOREIGN PATENT DOCUMENTS

| | | | |
|---|---|---|---|
| JP | 54-141548 | U | 10/1979 |
| JP | 57-58867 | U | 4/1982 |
| JP | U-S58-116976 | | 8/1983 |
| JP | 61-41563 | U | 3/1986 |
| JP | 02-70131 | U | 5/1990 |
| JP | 03-007825 | A | 1/1991 |
| JP | A-H03-113217 | | 5/1991 |
| JP | A-H03-255827 | | 11/1991 |
| JP | A-H03-255829 | | 11/1991 |
| JP | 06-123449 | A | 5/1994 |
| JP | A-H06-147550 | | 5/1994 |
| JP | 6-281204 | A | 10/1994 |
| JP | A-H06-281204 | | 10/1994 |
| JP | 8-128678 | A | 5/1996 |
| JP | 09-126497 | A | 5/1997 |
| JP | 10-141708 | A | 5/1998 |
| JP | 10-227489 | A | 8/1998 |
| JP | 10-267325 | A | 10/1998 |
| JP | A-H11-118198 | | 4/1999 |
| JP | A-H11-173605 | | 7/1999 |
| JP | A-H11-201506 | | 7/1999 |
| JP | 11-304196 | A | 11/1999 |
| JP | A-H11-337130 | | 12/1999 |
| JP | 2000-74422 | A | 3/2000 |
| JP | A-2000-161717 | | 6/2000 |

* cited by examiner

OUTDOOR UNIT OF REFRIGERATOR, AND ELECTRICAL EQUIPMENT BOX OF OUTDOOR UNIT

TECHNICAL FIELD

The present invention relates to an outdoor unit of a refrigerator and an electrical equipment box of an outdoor unit. More particularly, the present invention relates to a type of outdoor refrigerator unit that draws in air from a side face, exchanges heat with the air, and blows the air out through a top face and an electrical equipment box that is provided inside the casing of such an outdoor unit and serves to house electrical components.

BACKGROUND ART

Some of the outdoor units of air conditioning systems, which are one type of refrigerator, are of the type that draw in air from a side face, exchange heat with the air, and blow the air out through a top face. This kind of outdoor unit is used to condition the air of office buildings and the like; it is installed on the roof of a building and connected to a plurality of indoor units through communication pipings. This kind of outdoor unit is provided with a generally rectangular-parallelepiped-shaped casing inside of which are provided such devices as a compressor, a heat exchanger, and a blower fan. An air inlet is provided on a side face of the casing and an upwardly directed air outlet is provided on a top face of the casing. More specifically, air inlets are provided in the two side faces and the rear face of the casing but not the front face. The heat exchanger serves to exchange heat with the air drawn in from the air inlets and is arranged inside the casing so as to face each of the air inlets. The blower fan is a propeller fan for discharging air through the air outlet after the air has exchanged heat at the heat exchanger and is provided in an upper portion of the casing in such a manner as to be aligned with the air outlet. Additionally, an electrical equipment box that houses an inverter, a control circuit board, and other electrical components is provided inside the casing in such a manner as to face the front face so that it can be accessed from the front face side. More specifically, the electrical equipment box is a generally rectangular-parallelepiped-shaped box provided below the blower fan when viewed from the front face side of the casing. When viewed from the top face side of the casing, the electrical equipment box has an elongated shape that runs toward both side faces and the amount by which it protrudes toward the rear face is small. When viewed from the front face side of the casing, the casing is divided into two spaces, i.e. a left space and right space (see, for example, Japanese Laid-Open Patent Publication No. 6-281204).

With an outdoor unit provided with such an electrical equipment box, the blower fan is driven and air is drawn in through the air inlets. Then, after the air exchanges heat with a refrigerant in the heat exchanger, the air is discharged from the air outlet. The air that is drawn in through the air inlets and discharged from the air outlet due to the blower fan being driven flows from bottom to top inside the casing (see, for example, Japanese Laid-Open Patent Publication No. 8-128678).

The outdoor unit just described requires a large capacity in order to accommodate as many indoor units as possible. However, simply speaking, in order to increase the capacity of the outdoor unit, it is necessary to enlarge the heat exchanger and the blower fan and, as a result, the size of the outdoor unit becomes large. This increase in size causes such problems as a decrease in the loading efficiency of the unit during transport and difficulty in carrying the unit to such places as the roof of a building. Consequently, it is necessary to make the outdoor unit more compact in addition to increasing the capacity of the outdoor unit. It is particularly necessary to reduce the size of the outdoor unit when viewed from the top face because the size of the outdoor unit when viewed from the top face has a large effect on the loading of the unit during transport and the carrying of the unit to such places as the roof of a building.

However, if the size of the outdoor unit when viewed from the top face is constrained, the amount by which the electrical equipment box protrudes into the portion where the blower fan is conducting its blowing work will be larger because the blower fan will be larger due to the increase in capacity of the outdoor unit. As a result, the flow of air from bottom to top inside the casing will be impeded and the air flow resistance will increase. Consequently, there is the possibility that the blowing performance of the blower fan will decline and that noise will increase.

Meanwhile, the electrical equipment box must have a prescribed volume in order to house all of the various electrical equipment components. It is also necessary to cool the electrical equipment box on a continuous basis when the outdoor unit is in operation because several electrical components that emit large amounts of heat are housed inside the electrical equipment box. Consequently, the electrical equipment box must be arranged so as to protrude into the portion where the blower fan is conducting its blowing work by the amount necessary to accomplish the cooling.

Also, the electrical components housed in the electrical equipment box of the outdoor unit described above are arranged in such a manner as to be separated according to function and characteristics. For example, electrical components that emit large amounts of heat (high heat emission components)—including strong current components such as inverters and reactors—are arranged in one of the two aforementioned left and right spaces and electrical components that emit small amounts of heat (low heat emission components)—including weak current components such as control circuit boards—are arranged in the other of the two planarly divided spaces. Moreover, it is necessary to make the outdoor unit described above more compact; particularly from the perspective of transport, it is necessary to reduce the size of the outdoor unit when viewed from the top face. However, if the size of the outdoor unit when viewed from the top face is constrained, it becomes spatially difficult to arrange the electrical equipment box (which has two spaces, one on the left and one on the right). Consequently, it is necessary to make the electrical equipment box more compact.

Since the sizes of the electrical components arranged inside the electrical equipment box are various, the amount by which the electrical equipment box protrudes from the front face toward the rear face is determined by the size of the largest electrical component in the case of an electrical equipment box having two spaces (one on the left and one on the right). Consequently, it is likely that some of the space inside the electrical equipment box will be wasted. Moreover, if one attempts to reduce the size of the outdoor unit when viewed from the top face, the amount by which the electrical equipment box protrudes toward the rear face will be larger, the flow of air from bottom to top inside the casing will be impeded, and the air flow resistance will increase. Consequently, there is the possibility that the blowing performance of the blower fan will decline and that noise will increase.

Thus, it is difficult to reduce the size of an electrical equipment box that is constructed to have two spaces, one on the left and one on the right, in which the electrical components are arranged in a planar manner arranged generally along a horizontal plane. Although it is feasible to divide the electrical equipment box into a plurality of electrical equipment boxes arranged in places that do not impede the blowing work of the blower fan, such a configuration would increase the number of assembly steps required for the electrical equipment box and make it less convenient to access the electrical equipment box after the outdoor unit has been installed. It would also be difficult to arrange the electrical components such that they are separated according to function and characteristics.

SUMMARY OF THE INVENTION

A first object of the present invention is to reduce the size of an outdoor refrigerator unit of the type that draws in air from a side face, exchanges heat with the air, and blows the air out through a top face while ensuring that the electrical equipment box has sufficient volume and suppressing the increase in air flow resistance that results from reducing the size of the outdoor unit.

A second object of the present invention is to suppress the increase in the air flow resistance inside an outdoor refrigerator unit of the type that draws in air from a side face, exchanges heat with the air, and blows the air out through a top face without damaging the effectiveness with which the electrical equipment box is cooled.

A third object of the present invention is to eliminate wasted space inside and reduce the size of the electrical equipment box of an outdoor refrigerator unit of the type that draws in air from a side face, exchanges heat with the air, and blows the air out through a top face.

According to a first aspect of the present invention, an outdoor refrigerator unit is of the type that draws in air from a side face, exchanges heat with the air, and blows the air out through a top face, the outdoor unit being provided with a casing, an axial fan, and an electrical equipment box. The axial fan is provided in an upper portion of the casing and is configured to blow air that has been drawn in from a side face of the casing out through a top face of the casing. The electrical equipment box is arranged inside the casing and has a first box part that is provided below the axial fan and a second box part that is provided below the first box part and has a larger surface area in a plan view than the first box part.

In this outdoor unit, when the axial fan provided in an upper portion of the casing is driven, air is drawn in from a side face of the casing and, after exchanging heat, blown out through a top face of the casing. Since the electrical equipment box is configured such that the first box part is below the axial fan, an air flow path is secured in a position close to the axial fan where the effect on the air flow resistance is large and the increase in air flow resistance is suppressed. Meanwhile, since the electrical equipment box is configured such that the second box part is positioned below the first box part, i.e., far from the axial fan, the volume required for housing the various electrical components is secured.

Thus, with this outdoor unit, while volume is secured for the electrical equipment box, the air flow path in a position close to the axial fan is widened so that the air flow is not impeded and the increase in air flow resistance inside the outdoor unit can be suppressed.

According to a second aspect of the present invention, the outdoor unit of refrigerator of the first aspect of the present invention is provided, wherein the casing is generally rectangular in a plan view. The electrical equipment box is arranged such that it faces one side face of the casing. The second box part is provided such that it bulges outward beyond the first box part in a direction opposite of, i.e., away from, said one side face of the casing.

With this outdoor unit, the electrical equipment box can be accessed easily from one side face of the casing because the electrical equipment box is arranged so as to face one side face of the casing and the second box part bulges outward in a direction opposite of, i.e., away from, said side face of the casing. As a result, the outdoor unit can be assembled more easily and worked on more easily onsite.

According to a third aspect of the present invention, the outdoor unit of refrigerator of the first or second aspects of the present invention is provided, wherein the electrical equipment box is further provided with a slanted part. The slanted part is provided vertically-between the second box part and the first box part and is configured such that its surface area in a plan view decreases as one moves from the top end of the second box part to the bottom end of the first box part.

With this outdoor unit, the air drawn in through a side face of the casing can be made to flow smoothly toward the top face of the casing because a slanted part is provided between the second box part and the first box part of the electrical equipment box. As a result, the increase in air flow resistance inside the outdoor unit can be suppressed.

According to a fourth aspect of the present invention, an outdoor refrigerator unit is of the type that draws in air from a side face, exchanges heat with the air, and blows the air out through a top face, the outdoor unit being provided with a casing, an axial fan, and an electrical equipment box. The axial fan is provided in an upper portion of the casing and is configured to blow air drawn in from a side face of the casing out through a top face of the casing. The electrical equipment box is arranged inside the casing such that it faces one side face of the casing, and a portion of the electrical equipment box facing in a direction opposite of, i.e., away from said one side face of the casing is shaped such that it follows the streamline along which the air drawn in from a side face of the casing flows toward the top face of the casing.

In this outdoor unit, when the axial fan provided in an upper portion of the casing is driven, air is drawn in from a side face of the casing and, after exchanging heat, blown out through a top face of the casing. With this outdoor unit, the air drawn in through a side face of the casing can be made to flow smoothly toward the top face of the casing because the electrical equipment box is arranged inside the casing such that it faces one side face of the casing and a portion of the electrical equipment box facing in a direction opposite of, i.e., away from said one side face of the casing is shaped such that it follows the streamline along which the air drawn in from a side face of the casing flows toward the top face of the casing.

Thus, with this outdoor unit, the increase in air flow resistance inside the outdoor unit can be suppressed because the electrical equipment box does not impede the flow of air from a side face of the casing toward the top face.

According to a fifth aspect of the present invention, the outdoor unit of refrigerator of any one of the second to fourth aspects of the present invention is provided, wherein the electrical equipment box is arranged such that, in a plan view, it is offset from the center of said one side face of the casing.

With this outdoor unit, since the electrical equipment box is arranged such that it is offset from the center of said one side face of the casing, it is easy to secure an air flow path in a position close to the axial fan where the effect on the air flow resistance is large and the increase in air flow resistance is suppressed even further.

According to a sixth aspect of the present invention, the outdoor unit of refrigerator of any one of the first to fifth aspects of the present invention is provided, wherein the electrical equipment box is arranged such that, in a plan view, it overlaps the region where the axial fan conducts blowing work.

In this outdoor unit, the electrical equipment box is arranged such that, in a plan view of the casing, it overlaps the region where the axial fan conducts blowing work. Even though the electrical equipment box overlaps the region where the axial fan conducts blowing work, the surface area of the overlapping portion in the vicinity of the axial fan can be held to a minimum because the electrical equipment box is provided with a first box part and a second box part. In particular, the increase of the air flow resistance inside the outdoor unit can be suppressed more efficiently because the amount of overlap near the outer circumference of the axial fan, where the effect on the air flow resistance is large, can be reduced.

According to a seventh aspect of the present invention, an outdoor refrigerator unit is of the type that draws in air from a side face, exchanges heat with the air, and blows the air out through a top face, the outdoor unit being provided with a casing, an axial fan, and an electrical equipment box. The casing is generally rectangular in a plan view. The axial fan is provided in an upper portion of the casing and is configured to blow air drawn in from a side face of the casing out through a top face of the casing. The electrical equipment box is arranged below the axial fan inside the casing such that, in a plan view of the casing, it overlaps the region where the axial fan conducts blowing work. In a plan view of the casing, the ratio of the overlapping surface area (i.e., the surface area of the portion where the electrical equipment box overlaps the region where the axial fan conducts blowing work) to the blowing surface area (i.e., the surface area of the region where the axial fan conducts blowing work) is 0.09 or less.

In this outdoor unit, when the axial fan provided in an upper portion of the casing is driven, air is drawn in from a side face of the casing and, after exchanging heat, blown out through a top face of the casing. The electrical equipment box is arranged such that it overlaps the region where the axial fan conducts blowing work and configured such that the surface area ratio of the overlapping surface area is 0.09 or less. As a result of diligent research conducted by the inventors of the present invention, this surface area ratio was discovered to be a value with which the increase in the air flow resistance can be suppressed without damaging the effectiveness with which the electrical equipment box is cooled. This surface area ratio enables the amount by which the electrical equipment box protrudes into the region where the axial fan conducts blowing work to be suppressed and the increase in air flow resistance to be suppressed without damaging the effectiveness with which the electrical equipment box is cooled.

According to an eighth aspect of the present invention, the outdoor unit of refrigerator of the seventh aspect of the present invention is provided, wherein, in a plan view of the casing, the ratio of the fan outside diameter of the axial fan to the length of a short side of the casing is 0.89 or greater.

With this outdoor unit, the fan outside diameter of the axial fan is larger in comparison with the length of a short side of the casing in order to reduce the size of the casing in a plan view. Even in the case of an outdoor unit configured in this manner, by setting the overlapping surface area ratio with which the electrical equipment box overlaps the region where the axial fan conducts blowing work to 0.09 or less, the amount by which the electrical equipment box protrudes into the region where the axial fan conducts blowing work can be suppressed and the increase in air flow resistance can be suppressed without damaging the effectiveness with which the electrical equipment box is cooled.

According to a ninth aspect of the present invention, the outdoor unit of refrigerator of the eighth aspect of the present invention is provided, wherein, in a plan view of the casing, the ratio of the length of a short side of the casing to the length of a long side of the casing is 0.80 or greater.

With this outdoor unit, the shape of the casing in a plan view is brought closer to a square shape in order to reduce the size of the casing in a plan view. Even in the case of an outdoor unit configured in this manner, by setting the overlapping surface area ratio with which the electrical of equipment box overlaps the region where the axial fan conducts blowing work to 0.09 or less, the amount by which the electrical equipment box protrudes into the region where the axial fan conducts blowing work can be suppressed and the increase in air flow resistance can be suppressed without damaging the effectiveness with which the electrical equipment box is cooled.

According to a tenth aspect of the present invention, the outdoor unit of refrigerator of any one of the seventh to ninth aspects of the present invention is provided, wherein the electrical equipment box is arranged such that it faces one side face of the casing.

With this outdoor unit, the outdoor unit can be assembled more easily and worked on more easily onsite because the electrical equipment box can be accessed easily from one side face of the casing.

According to an eleventh aspect of the present invention, the outdoor unit of refrigerator of the tenth aspect of the present invention is provided, wherein the electrical equipment box is arranged such that, in a plan view of the casing, it is offset from the center of said one side face of the casing.

With this outdoor unit, the surface area of the overlapping portion can be reduced and the increase in air flow resistance can be suppressed because the electrical equipment box is offset from the center of said one side face.

According to a twelfth aspect of the present invention, the outdoor unit of refrigerator of the eleventh aspect of the present invention is provided, wherein the electrical equipment box is arranged such that, in a plan view of the casing, it is located in a corner section of the casing.

With this outdoor unit, the surface area of the overlapping portion can be reduced and the increase in air flow resistance can be suppressed because the electrical equipment box is arranged in a corner section of the casing.

According to a thirteenth aspect of the present invention, the outdoor unit of refrigerator of any one of the seventh to twelfth aspects of the present invention is provided, wherein the electrical equipment box is shaped such that its surface area in a plan view increases as one moves downward away from the axial fan.

With this outdoor unit, since the electrical equipment box is shaped such that, in a plan view, its surface area increases as one moves downward away from the axial fan, an air flow path can be secured in a position close to the axial fan where the effect on the air flow resistance is large and the air drawn in through a side face of the casing can be made to flow smoothly toward the top face of the casing. As a result, the increase in the air flow resistance can be suppressed.

According to a fourteenth aspect of the present invention, an electrical equipment box of outdoor unit is configured to house electrical equipment components and is provided inside the casing of an outdoor refrigerator unit of the type that draws in air from a side face, exchanges heat with the air, and blows the air out through a top face, the electrical equipment box being provided with a box main body, a lid member, and a partition plate. The box main body is provided such that it faces one side face of the casing and has an opening in the side thereof that faces said one side face. The lid member is arranged so as to cover the opening in the box main body. The partition plate is provided inside the box main body and serves to partition the space inside the box main body into a front space on the lid member side and a back space on the side opposite from the lid member.

With this electrical equipment box, various sizes and shapes of electrical components can be arranged not only planarly but in a three-dimensional manner because the box main body has a two-layered structure that is divided by the partition plate into a front space and a back space in which electrical components can be housed. As a result, wasted space inside the box main body can be eliminated and the electrical equipment box can be made more compact.

According to a fifteenth aspect of the present invention, the electrical equipment box of outdoor unit of the fourteenth aspect of the present invention is provided, wherein the partition plate is made of resin.

With this electrical equipment box, the front space and the back space can be electrically insulated from each other with ease. It is also possible to mount electrical components directly to the partition plate.

According to a sixteenth aspect of the present invention, the electrical equipment box of outdoor unit of the fourteenth or fifteenth aspects of the present invention is provided, wherein the electrical components include first electrical components that are accessed with a high degree of frequency after the outdoor unit is installed and second electrical components that are accessed with a low degree of frequency after the outdoor unit is installed. The first electrical components are arranged in the front space.

With this electrical equipment box, the first electrical components, i.e., electrical components (e.g., a control circuit board) that are accessed with a high degree of frequency after the outdoor unit is installed, are arranged in the front space and can therefore be accessed by simply removing the lid member (e.g., when accessing a control circuit board for the purpose of adjusting settings).

According to a seventeenth aspect of the present invention, the electrical equipment box of outdoor unit of any one of the fourteenth to sixteenth aspects of the present invention is provided, wherein the electrical components include low heat emission components that emit small amounts of heat when the outdoor unit is in operation and high heat emission components that emit large amounts of heat when the outdoor unit is in operation. The high heat emission components are arranged in the back space.

With this electrical equipment box, it is easier to cool the high heat emission components—i.e., such components as inverters and reactors which emit larger amounts of heat than control circuit boards and other low heat emission components—using the air flow inside the casing because the high heat emission components are arranged in the back space.

According to an eighteenth aspect of the present invention, the electrical equipment box of outdoor unit of the seventeenth aspect of the present invention is provided, wherein the box main body has cooling fins that project in a direction opposite of said one side face of the casing.

With this electrical equipment box, the cooling fins projecting in a direction opposite of said one side face of the casing enable cooling of the back space by the air flowing through the inside of the casing to be promoted.

According to a nineteenth aspect of the present invention, the electrical equipment box of outdoor unit of any one of the fourteenth to eighteenth aspects of the present invention is provided, wherein the partition plate has a window section that links the front space and back space together.

With this electrical equipment box, a window section is provided in the partition plate and electrical components arranged in the back space can be accessed without removing the partition plate. Thus, for example, if it becomes necessary to access one of the second electrical components (i.e., electrical components that are accessed with a low degree of frequency after the outdoor unit is installed), the component can be accessed while leaving the partition plate in its installed state. With this electrical equipment box, it is also possible to install first electrical components (i.e., electrical components that are accessed with a high degree of frequency after the outdoor unit is installed) in the back space.

According to a twentieth aspect of the present invention, the electrical equipment box of outdoor unit of any of the fourteenth to nineteenth aspects of the present invention is provided, wherein a bulged part that bulges outward in a direction opposite of, i.e., away from, said one side face of the casing is provided on a portion of the box main body.

With this electrical equipment box, the bulged part makes it possible to widen a portion of the front space and the back space and, thus, makes it possible to install long electrical components, such as noise filters.

According to a twenty-first aspect of the present invention, the electrical equipment box of outdoor unit of the twentieth aspect of the present invention is provided, wherein the bulged part is provided on a lower portion of the box main body.

With this electrical equipment box, the increase in air flow resistance inside the outdoor unit can be suppressed because the bulged part is provided on a lower portion of the box main body.

According to a twenty-second aspect of the present invention, the electrical equipment box of outdoor unit of the twentieth aspect of the present invention is provided, wherein the box main body comprises a sheet metal box part made of metal and a resin box part made of resin.

With this electrical equipment box, cooling can be promoted by arranging high heat emission components (i.e., inverters, reactors, and other components that emit a large amount of heat) in the sheet metal box part.

According to a twenty-third aspect of the present invention, the electrical equipment box of outdoor unit of the twenty-second aspect of the present invention is provided, wherein the bulged part is provided on a lower portion of the box main body. The sheet metal box part constitutes the upper portion of the box main body. The resin box part constitutes the lower portion of the box main body and includes the bulged part.

With this electrical equipment box, the bulged part is easy to form because it is formed by molding resin. Also, making a portion of the box main body out of resin can contribute to reducing the cost of the electrical equipment box.

BRIEF DESCRIPTIONS OF THE DRAWINGS

PREFERRED EMBODIMENTS OF THE INVENTION

Embodiments of the present invention will now be described with reference to the drawings.

FIRST EMBODIMENT (1) Constituent Features of the Outdoor Unit

Figure 1:
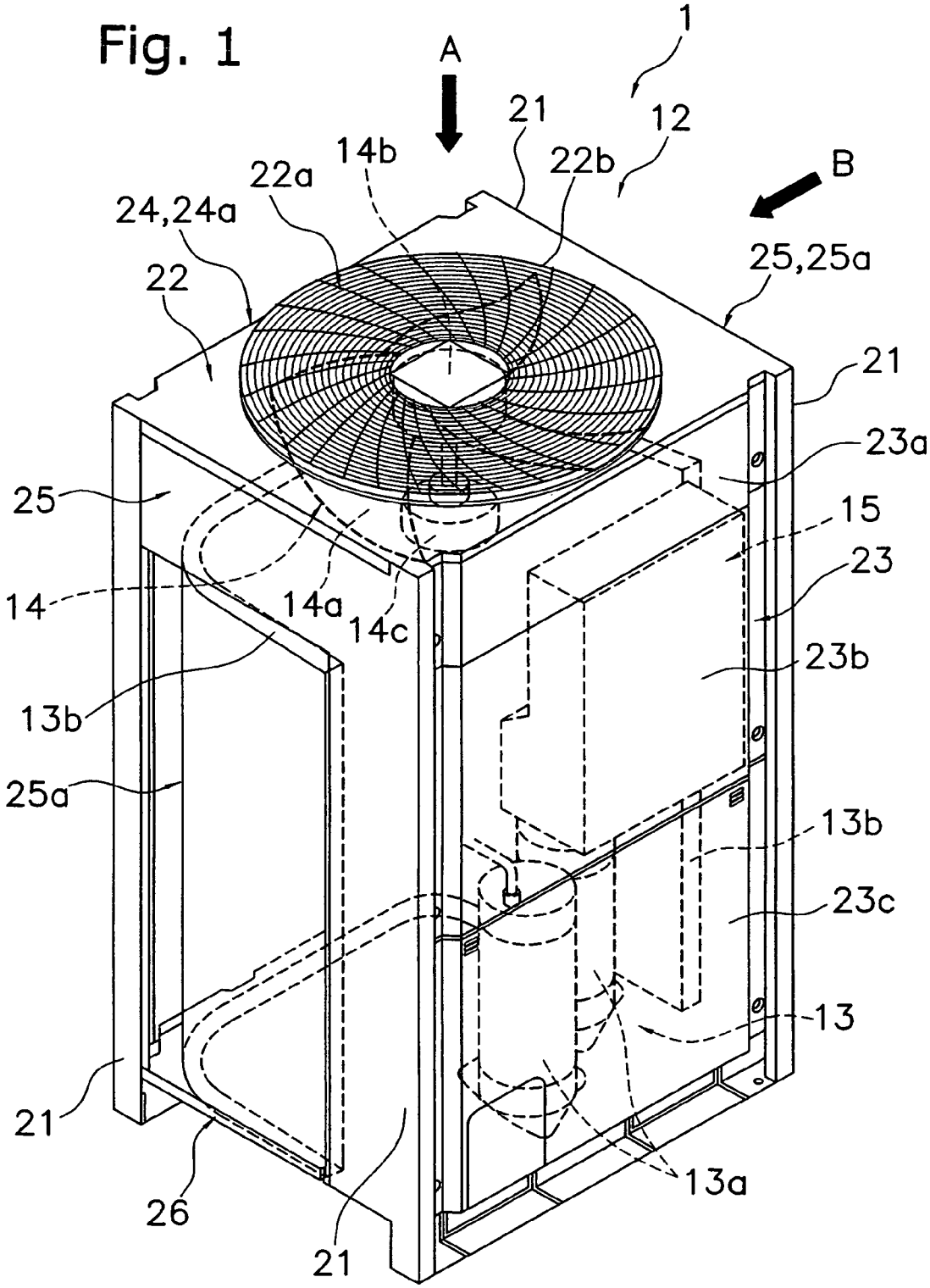
FIG. 1 is a schematic perspective view of the outdoor unit of an air conditioning system in accordance with a first embodiment of the present invention.

FIG. 1 shows an outdoor unit 1 for an air conditioning system (which is one type of refrigerator) in accordance with a first embodiment of the present invention. The outdoor unit 1 forms part of a multiple-unit type air conditioning system. It is installed on the roof of an office building or the like and connected to a plurality of indoor units through communication pipings.

The outdoor unit 1 is of the type that draws in air from a side face, exchanges heat with the air, and blows the air out through a top face and is provided with the following: a casing 12; an outdoor refrigerant circuit 13 housed inside the casing 12; a blower fan 14 (axial fan) provided in an upper portion of the casing 12; and an electrical equipment box 15 housed inside the casing 12.

The casing 12 has the general shape of a rectangular parallelepiped and comprises chiefly the following: supports 21 arranged at each of the four corners of the casing 12; a top panel 22; a front panel 23; a rear panel 24; a pair of side panels 25; and a bottom panel 26.

The supports 21 are pillar-like members that are arranged at each corner of the casing 12 and extend from the top edge to the bottom edge of the casing 12. The supports 21 secure and support the top panel 22, the front panel 23, the rear panel 24, the pair of side panels 25, and the bottom panel 26.

An air outlet 22*a* (top face) comprising an opening is provided in the center of the top panel 22 and a fan grill 22*b* is provided in such a manner as to cover the top of the opening. Air drawn into the casing 12 is discharged upward through the air outlet 22*a*.

In this embodiment, the front panel 23 comprises an upper front panel 23*a* arranged below the top panel 22, a middle front panel 23*b* arranged below the upper front panel 23*a*, and a lower front panel 23*c* arranged below the middle front panel 23*b*. Thus, the front panel 23 is constructed so as to be divided into three sections: upper, middle, and lower.

The rear panel 24 has an air inlet 24*a* for drawing air into the casing 12. In this embodiment, the air inlet 24*a* (not shown in the figures) comprises an opening that occupies substantially the entire face of the rear panel 24. The two side panels 25 have an air inlets 25*a* for drawing air into the casing 12. In this embodiment, each of the air inlets 25*a* comprises an opening that occupies a portion of the side panel 25 that excludes a portion close to the front panel 23. Air is drawn into the casing 12 through these air inlets 24*a*, 25*a*.

The bottom panel 26 supports and secures the devices and piping that make up the outdoor refrigerant circuit 13. The bottom panel 26 is supported on the four supports 21 such that a space is formed between the bottom panel 26 and the installation surface.

The outdoor refrigerant circuit 13 includes a compressor 13*a*, a heat exchanger 13*b*, and piping that serves to connect these devices together. The compressor 13*a*, heat exchanger 13*b*, and other main devices are secured to the bottom panel 26. In short, the devices and piping that make up the outdoor refrigerant circuit 13 are arranged chiefly in the bottom section of the casing 12. The heat exchanger 13*b* is U-shaped and arranged such that it faces the three air inlets 24*a*, 25*a*. The heat exchanger 13*b* is capable of exchanging heat between a refrigerant and air drawn in through the air inlets 24*a*, 25*a*.

The blower fan 14 is a propeller fan and is arranged in an upper portion of the casing 12 in such a manner as to be aligned with the air outlet 22*a*. The blower fan 14 includes a plurality of propeller blades 14*a*, a hub 14*b* that secures the radially inward portions of the propeller blades 14*a*, and a fan motor 14*c* that rotationally drives the hub 14*b*. The fan motor 14*c* is fixed to the casing 12 by means of a support frame (not shown). More specifically, the blower fan 14 is arranged in a position corresponding to the vertical position of the upper front panel 23*a*. Thus, the blower fan 14 draws outdoor air into the casing from side faces of the casing 12 through the air inlets 24*a*, 25*a* and, after the air has passed through the heat exchanger 13*b*, directs the air to the top of the casing 12 where the air is discharged through the air outlet 22*a*.

The electrical equipment box 15 is a box body in which such electrical equipment components as an inverter and a control circuit board are housed and is arranged such that it faces the front panel 23. More specifically, the electrical equipment box 15 is arranged such that it faces the middle front panel 23*b* and avoids the bottom portion of the casing 12 where the many devices and piping that make up the outdoor refrigerant circuit 13 are arranged. That is, the electrical equipment box 15 is arranged in a position below the blower fan 14 and above the lower front panel 23*c*.

(2) External Shape and Arrangement of the Electrical Equipment Box

Figure 2:
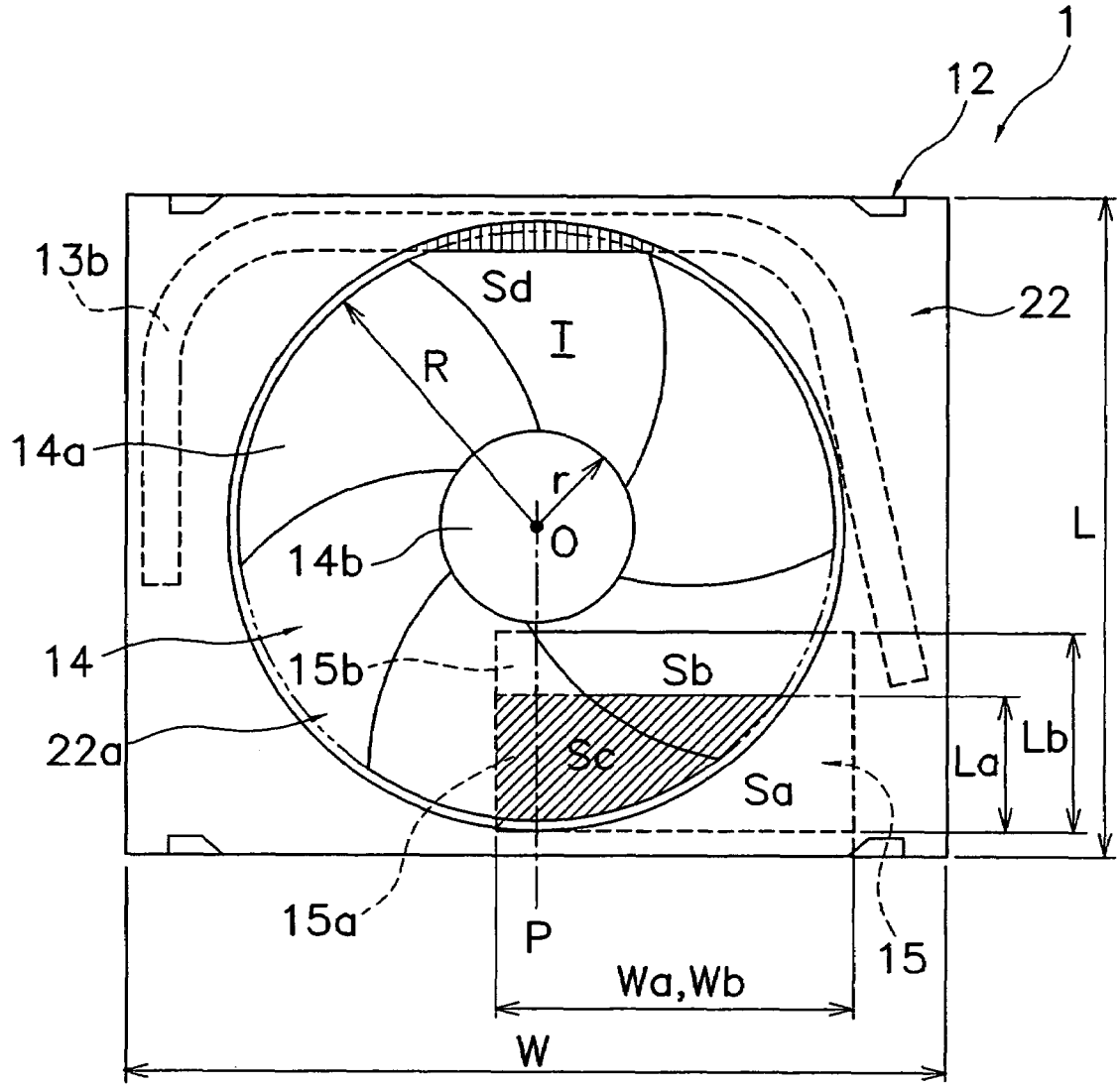
FIG. 2 is a view from direction A in FIG. 1 showing the outdoor unit without the fan grill of the top face.
Figure 3:
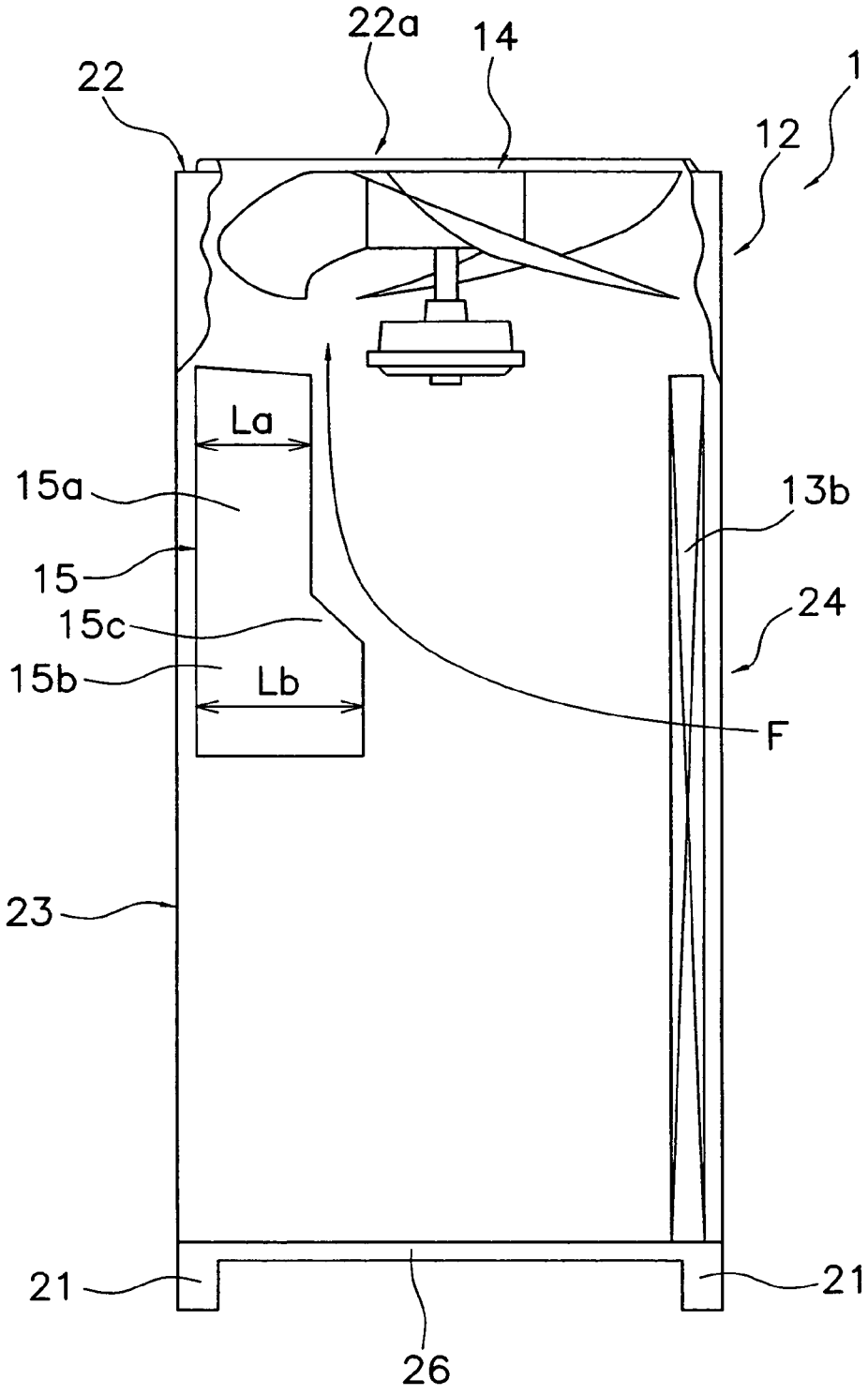
FIG. 3 is a view from direction B in FIG. 1 showing a cross section of the inside of the casing.

The external shape and arrangement of the electrical equipment box 15 will now be described using FIGS. 2 and 3. FIG. 2 is a view from direction A in FIG. 1 showing the outdoor unit 1 with the fan grill 22*b* of the top panel 22 excluded from the figure. FIG. 3 is a view of the outdoor unit 1 from direction B in FIG. 1 showing an internal cross section of the casing 12 with the compressor 13*a* and other devices excluded from the figure.

As shown in FIG. 2, the electrical equipment box 15 has a first box part 15*a* that is provided below the blower fan 14 and a second box part 15*b* that is provided below the first box part 15*a* and has a larger surface area Sb in a plan view than the surface area Sa of first box part 15*a* in a plan view. More specifically, the first box part 15*a* is the portion having the width dimension Wa and the length dimension La in a plan view. The second box part 15*b* is the portion having the width dimension Wb and the length dimension Lb in a plan view. Here, the width Wb is the same as the width Wa. The length Lb is longer than the length La and the second box part 15*b* bulges toward the rear panel 24 in comparison to the first box part 15*a*.

The electrical equipment box 15 is arranged such that, in a plan view, it overlaps the portion where the blower fan 14 conducts blowing work. The "region where the blower fan 14 conducts blowing work" refers to the region where the propeller blades 14*a* pass when the blower fan 14 is running. In this embodiment, said portion is the annular region T obtained by subtracting the circular region defined by the radius r of the hub 14*b* from the circular region defined by the radius R from the rotational center 0 of the blower fan 14 to the radially outer edge of the propeller blades 14*a* (hereinafter referred to as the fan outside diameter D, which is two times the radius R). The portion of the electrical equipment box 15 close to the blower fan 14 (more specifically, the portion of the surface area Sa of the first box part 15*a*) that overlaps the region T in a plan view has a surface area Sc (cross-hatched area in FIG. 2). It is preferred that the ratio (Sc/Sd) of the overlapping surface area Sc to the surface area Sd of the region T be 0.09 or less.

The electrical equipment box 15 is arranged such that it is offset from the center of the front panel 23 (more specifically, from the center line O-P in FIG. 2). In this embodiment, the electrical equipment box 15 is offset to the right of the center line O-P of the front panel 23 and arranged close to the corner of the casing 12.

As shown in FIG. 3, the electrical equipment box 15 has a slanted part 15*c* that is provided vertically-between the second box part 15*b* and the first box part 15*a* in a side view and is configured such that its surface area in a plan view decreases as one moves from the top end of the second box part 15*b* to the bottom end of the first box part 15*a*. Consequently, the portion of the electrical equipment box 15 facing the rear panel 24 is shaped such that it follows the streamline F along which the air drawn in from the air inlets 24*a*, 25*a* on side faces of the casing 12 flows toward the air outlet 22*a* of the casing 12.

Figure 4:
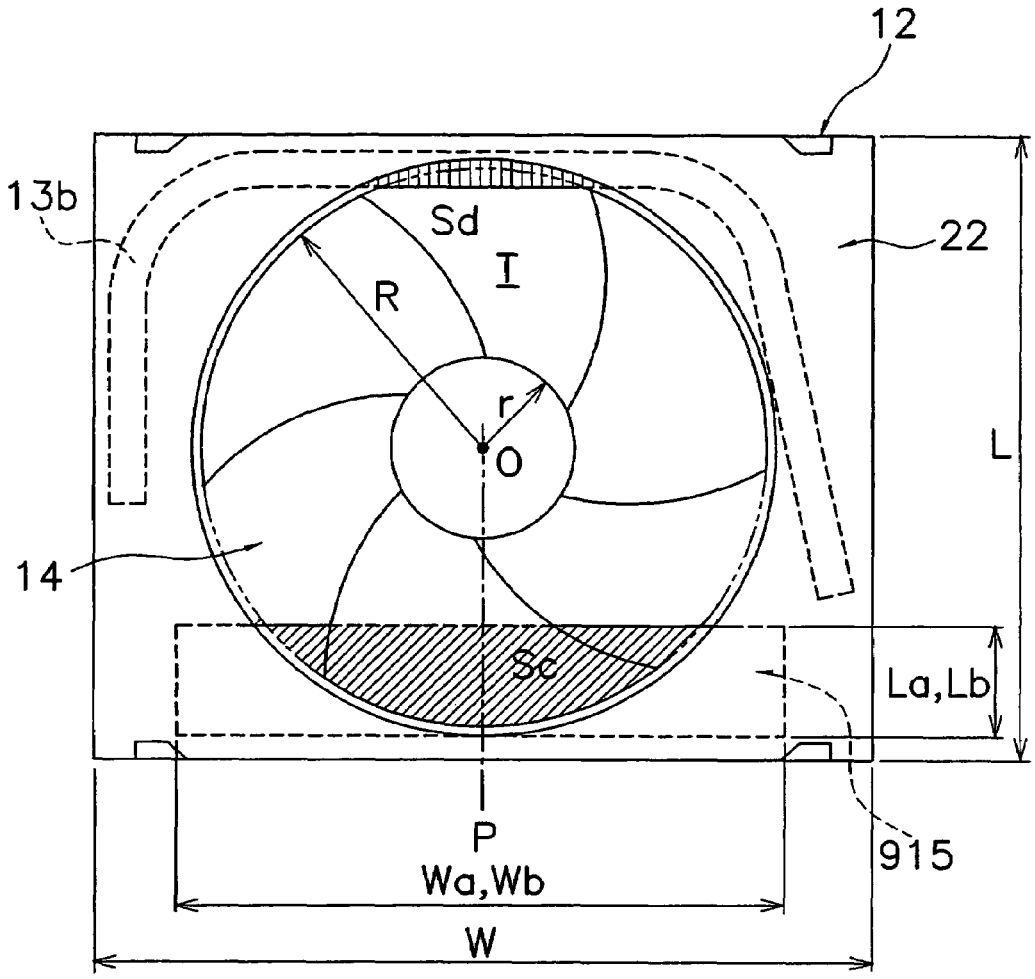
FIG. 4 is equivalent to FIG. 2 and shows an outdoor unit provided with an electrical equipment box in accordance with Experiment 2.

Thus, this electrical equipment box 15 protrudes somewhat more toward the rear panel 24 than a conventional electrical equipment box (e.g., that shown in FIG. 4) that is long in the widthwise direction and reaches across almost the entire width of the front panel 23, and the volume required to house the various electrical components is secured by providing the second box part 15*b* below the first box part 15*a*.

In this embodiment, since the ratio (D/L) of the fan outside diameter D of the blower fan 14 to the length L of a short side of the casing 12 in a plan view is 0.89 or larger, the outside edge of the air outlet 22*a* approaches close to the front panel 23 and rear panel 24. Also, in a plan view, the ratio (L/W) of the length L of a short side of the casing 12 to the length W of a long side is 0.80 or larger. Thus, with this embodiment, the size of the casing 12 of the outdoor unit 1 has been made more compact in a plan view.

(3) Operation of the Outdoor Unit

The operation of the outdoor unit 1 will now be described using FIGS. 2 and 3.

When the outdoor unit 1 is in operation, the blower fan 14 is driven and, as a result, air is drawn into the inside of the casing 12 through side faces thereof, i.e., through the air inlets 24*a*, 25*a*. The air drawn into the casing 12 passes through and exchanges heat with the heat exchanger 13*b*, which is arranged such that it faces the air inlets 24*a*, 25*a*. After exchanging heat, the air flows upward and is blown out through the air outlet 22*a* by the propeller blades 14*a* of the blower fan 14. As a result, after the air drawn into the casing 12 passes through the heat exchanger 13*b*, the air flows along such a streamline as to be directed simultaneously inward toward the inner portion of the casing and upward toward the air outlet 22*a*. For example, an air flow similar to streamline F develops at the portion of the electrical equipment box 15 that faces the rear panel 24.

Since the electrical equipment box 15 is configured to have a first box part 15*a* provided close to the blower fan 14, an air flow path is secured in a position close to the blower fan 14 where the effect on the air flow resistance is large and the increase in air flow resistance is suppressed. Additionally, since a slanted part 15*c* is provided vertically-between the second box part 15*b* and the first box part 15*a*, a surface is formed which follows a streamline F along which the air drawn in from the air inlets 24*a*, 25*a* on side faces of the casing 12 flows toward the air outlet 22*a* of the casing 12. As a result, the air that flows along the streamline F can be made to flow smoothly upward.

Furthermore, since the electrical equipment box 15 is configured to have a first box part 15*a* provided close to the blower fan 14 and an overlapping surface area ratio (Sc/Sd) of 0.09 or less, an air flow path is secured in a position close to the blower fan 14 where the effect on the air flow resistance is large and an overlapping surface area Sc is secured that is sufficient to enable cooling of the electrical equipment box 15. Thus, the electrical equipment box 15 is cooled and the increase in air flow resistance is suppressed.

(4) Experimental Verification

Experiments were conducted to confirm the air flow performance of an outdoor unit 1 in accordance with this embodiment. Two experiments were conducted: one (Experiment 1) using an outdoor unit 1 (FIG. 2) in accordance with this embodiment and another (Experiment 2) using an outdoor unit 1 (FIG. 4) in which an electrical equipment box 915 of the same type as used in conventional outdoor units is arranged in the casing 12.

The outdoor units and electrical equipment boxes used in the experiments will now be described.

The size and other conditions of the outdoor unit, excluding the electrical equipment box, were the same in both experiments: the length L of the short side of casing 12 was 770 millimeters; the length W of long side of the casing 12 was 930 millimeters; the fan outside diameter D of the blower fan 14 was 700 millimeters; and the distance between the bottom end portion of the blower fan 14 and the top end portion of the electrical equipment box 15,915 was 56 mm. The length L of the short side of the casing 12, i.e., 770 millimeters, is a size that can fit through the passages leading to the roofs of buildings and through the doors of elevators. Also, the ratio (D/L) of the fan outside diameter D to the length L of a short side of the casing 12 is 0.91 and the ratio (L/W) of the short side length L to the length W of a long side of the casing 12 is 0.83.

The size conditions for the electrical equipment box 15 in Experiment 1 were as follows: the length La of the first box part 15*a* was 160 millimeters; the length Lb of the second box part 15*b* was 230 millimeters; and the widths Wa, Wb of the first box part 15*a* and the second box part 15*b* were both 410 millimeters. The electrical equipment box 15 was arranged close to a corner of the casing 12 such that the overlapping area ratio (Sc/Sd) was 0.09.

The size conditions for the electrical equipment box 915 in Experiment 2 were as follows: the lengths La, Lb of the first box part 15*a* and the second box part 15*b* were both 150 millimeters and the widths Wa, Wb of the first box part 15*a* and the second box part 15*b* were both 800 millimeters. The electrical equipment box 915 was arranged to face the middle of the front panel 23 of the casing 12 such that the overlapping area ratio (Sc/Sd) was 0.10.

Under the conditions described above, the outdoor units were operated in such a manner that the flow rate of the blower fan 14 was 185 $m^3$/min and the rotational speed and noise value of the blower fans 14 in Experiment 1 and Experiment 2 were measured. The results will now be presented.

In Experiment 1, the rotational speed of the blower fan 14 was 813 rpm and the noise value was 59.9 dB. Meanwhile, in Experiment 2, the rotational speed of the blower fan 14 was 840 rpm and the noise value was 60.8 dB.

Thus, the air flow performance was better in Experiment 1 (in which the embodiment was adopted) than in Experiment 2 (in which a conventional arrangement was adopted). More specifically, the rotational speed was reduced by 27 rpm and the noise value was reduced by 0.8 dB. These results demonstrate that an effect of suppressing the increase in air flow resistance is achieved when the overlapping surface area (Sc/Sd) of this embodiment is set to 0.09 or less.

(5) Structural Details of the Electric Equipment Box

Figure 5:
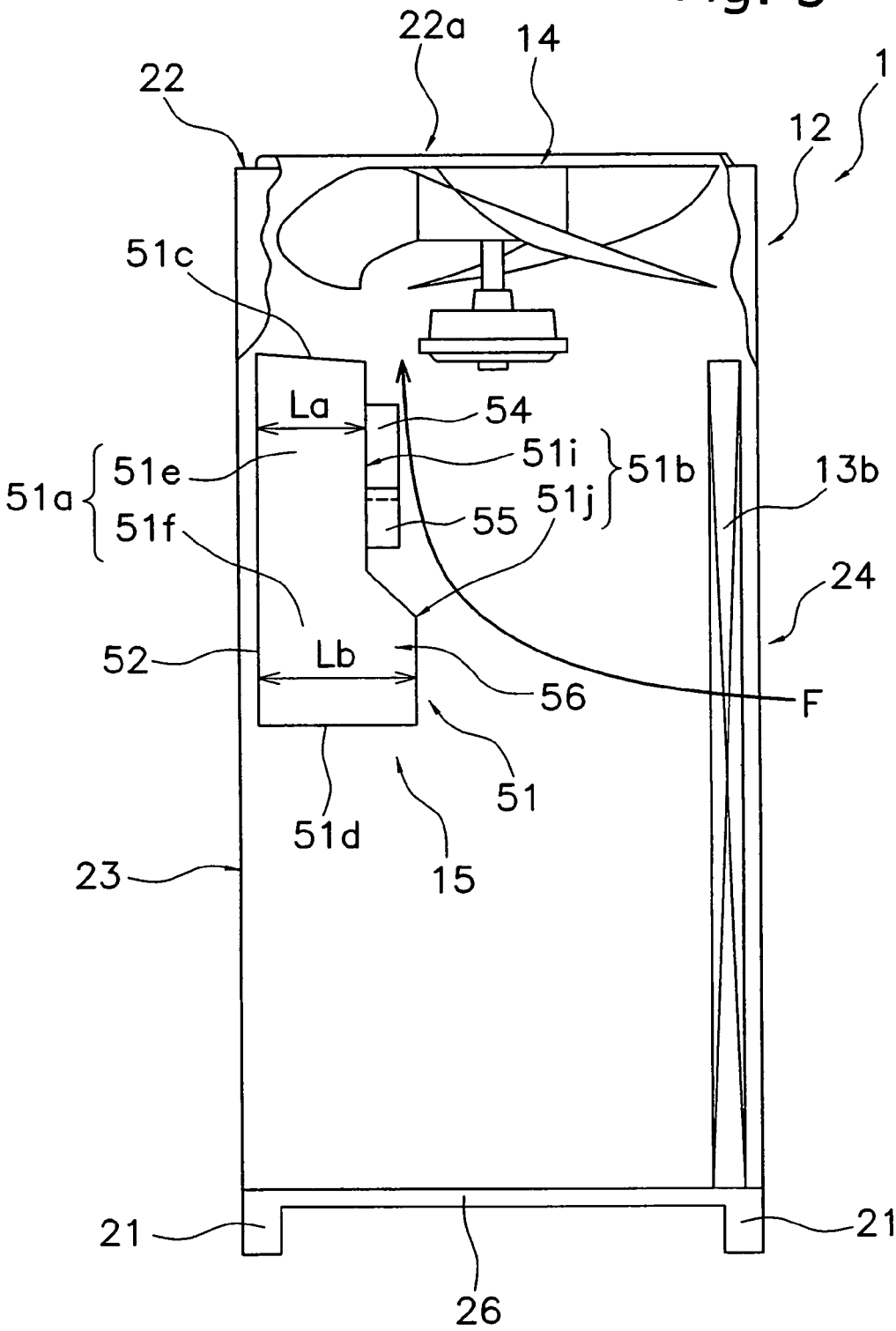
FIG. 5 is a view from direction B in FIG. 1 showing a cross section of the inside of the casing (shows the cooling fins of the electrical equipment box).
Figure 6:
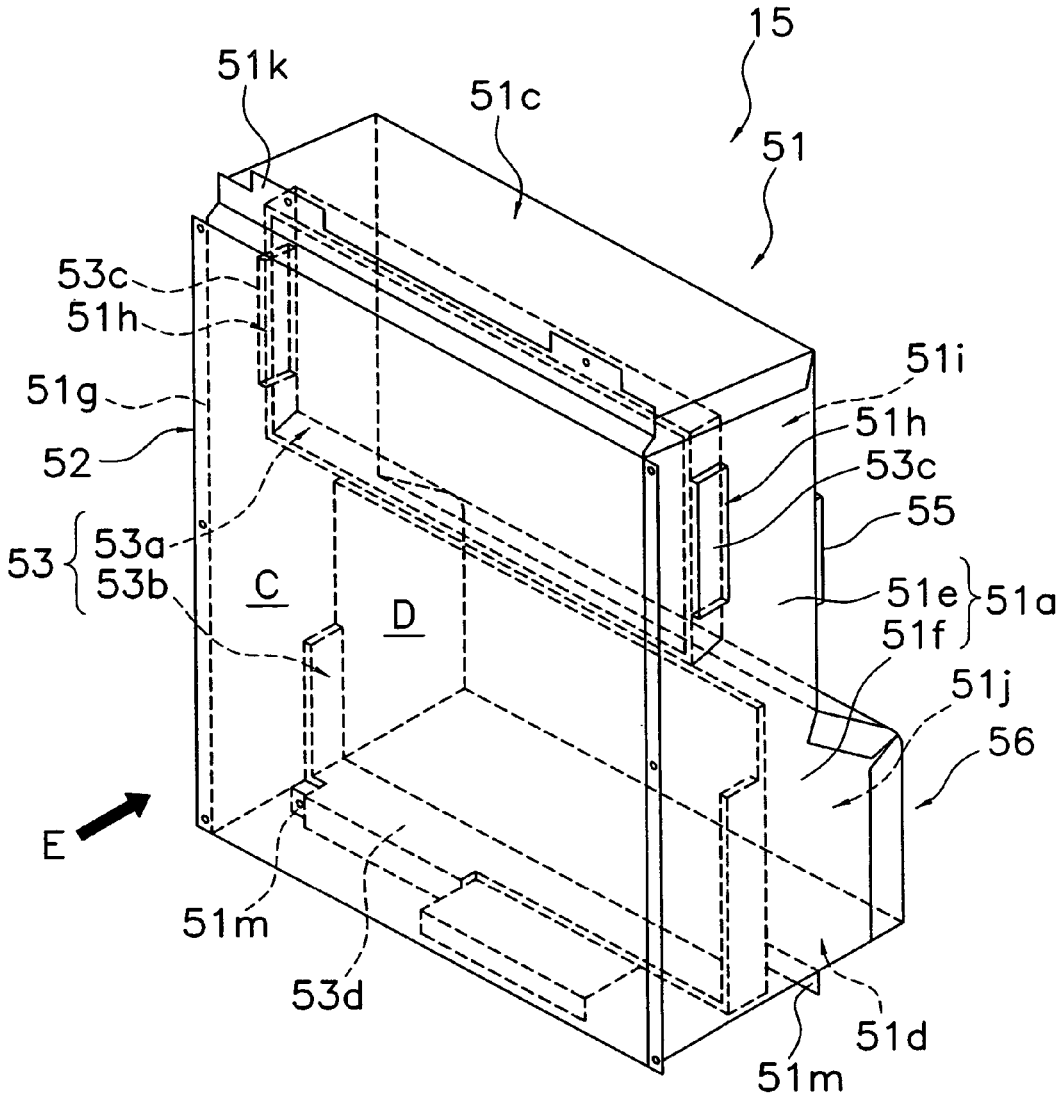
FIG. 6 is a perspective view showing the external appearance of the electrical equipment box.
Figure 7:
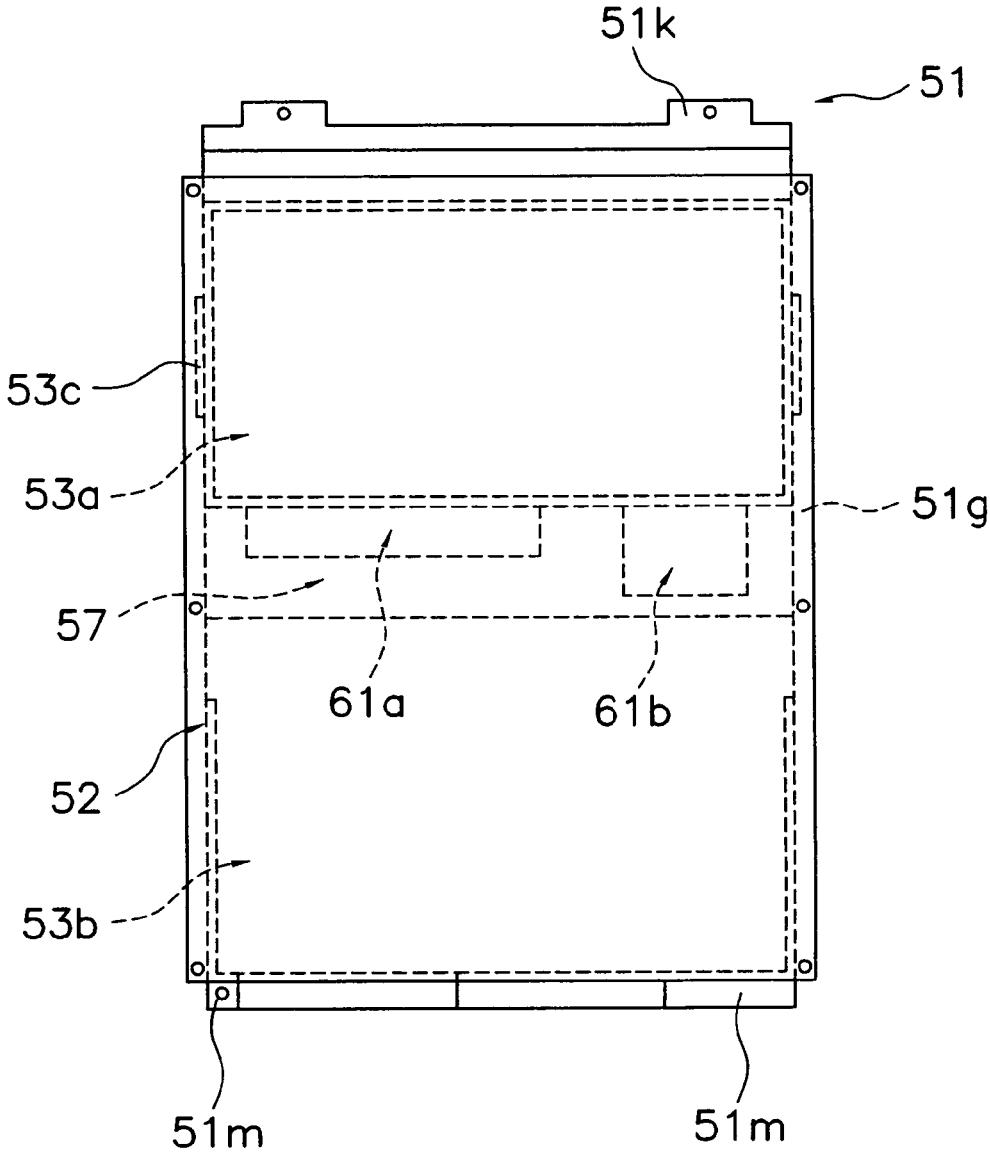
FIG. 7 is a view from direction E in FIG. 6.

The structural details of the electric equipment box 15 will now be described using FIGS. 5 to 7. FIG. 5 is a view of the outdoor unit 1 from direction B in FIG. 1 showing an internal cross section of the casing 12 with the compressor 13*a* and other devices excluded from the figure (the cooling fins of the electrical equipment box are shown). FIG. 6 is a perspective view of the external appearance of the electrical equipment box 15 and FIG. 7 is a view from direction E in FIG. 6.

The electrical equipment box comprises chiefly a box main body 51, a lid member 52, and a partition plate 53. The box main body 51 is provided such that it faces the front panel 23 of the casing 12 and has an opening in the side thereof that faces the front panel 23. The lid member 52 is a plate-like member arranged so as to cover the opening in the box main body 51. The partition plate 53 is provided inside the box main body 51 such that it partitions the space inside the box main body 51 into a front space C on the side closer to the front panel 23 of the casing 12 (i.e., lid member 52 side) and a back space D on the side closer to the rear panel 24 of the casing 12 (i.e., the side opposite from the lid member 52 side). Thus, the electrical equipment box 15 has a two-layered structure divided into two spaces, i.e., a front space C and a back space D, in which electrical components can be housed.

(A) Box Main Body

The box main body 51 has a pair of side face parts 51*a*, a rear face part 51*b*, a top face part 51*c*, and a bottom face part 51*d*. In this embodiment, the box main body 51 is made of sheet metal.

The side face parts 51*a* are generally L-shaped such that the lower portions thereof bulge outward toward the rear panel 24 of the casing 12. Each of the side face parts 51*a* comprises an upper side face part 51*e* that has a depth length La and a lower side face part 51*f* that is provided below the upper side face part 51*e* and has a depth length Lb that is larger than the depth length La. Lid fastening parts 51*g* for fastening the lid member 52 are provided on the vertical edges of the side face parts 51*a* that are closest to the front panel 23 of the casing 12. Each of the upper side face parts 51*e* is provided with a rectangular hole 51*h* comprising a rectangular hole.

The rear face part 51*b* is the portion of the box main body 51 constituting the face that faces toward the rear panel 24 of the casing 12. The rear face part 51*b* comprises an upper rear face part 51*i* that corresponds the upper side face parts 51*e* of the side face parts 51*a* and a lower rear face part 51*j* that corresponds to the lower side face parts 51*f* of the side face parts 51*a*. Cooling fins 54, 55 that protrude toward the rear panel 24 of the casing 12 are provided on the upper rear face part 51*i*.

The top face part 51*c* is the portion of the box main body 51 constituting the face that faces toward the top panel 22, and it is configured such that it slants downward toward the inner portion of the casing 12. The top face part 51*c* is provided with an upper fastening part 51*k* configured to be fastened by a support frame (not shown) of the casing 12.

The bottom face part 51*d* is the portion of the box main body 51 constituting the face that faces toward the bottom panel 26, and it is configured such that a portion is cut away on the lid member 52 side thereof. The bottom face part 51*d* is also provided with a lower fastening part 51*m* configured to be fastened by a support frame (not shown) of the casing 12.

The lower side face parts 51*f* of the pair of side face parts 51*a*, the lower rear face parts 51*j* of the rear face part 51*b*, and the bottom face part 51*d* constitute a bulging part 56 that bulges toward the rear panel 24 of the casing 12 and increases the depth dimensions of the spaces C and D.

(B) Lid Member

The lid member 52 is a generally rectangular plate-like member that is fastened to the lid fastening parts 51*g* with screws or the like. In this embodiment, the lid member 52 is made of sheet metal.

(C) Partition Plate

The partition plate 53 in this embodiment comprises two plate-like members, an upper partition plate 53*a* and a lower partition plate 53*b*. In this embodiment, the partition plates 53*a*, 53*b* are made of resin.

The upper partition plate 53*a* is a plate-like member provided inside the box main body 51 in a position corresponding to the upper side face parts 51*e* of the side face parts 51*a*. Each of the two side faces of the upper partition plate 53*a* is provided with a mating part 53*c* comprising a rectangular projection. The mating parts 53*c* mate with the rectangular hole parts 51*h* provided in the upper side face parts 51*e* and thereby support the upper partition plate 53*a*.

The lower partition plate 53*b* is a plate-like member provided inside the box main body 51 in a position corresponding to the lower side face parts 51*f* of the side face parts 51*a*. A support part 53*d* that is supported on the bottom face part 51*d* of the box main body 51 is provided on a bottom portion of the lower partition plate 53*b*.

A window section 57 that links the front space C and back space D together is provided vertically-between upper partition plate 53*a* and the lower partition plate 53*b*.

(D) Arrangement of the Electric Components

Figure 8:
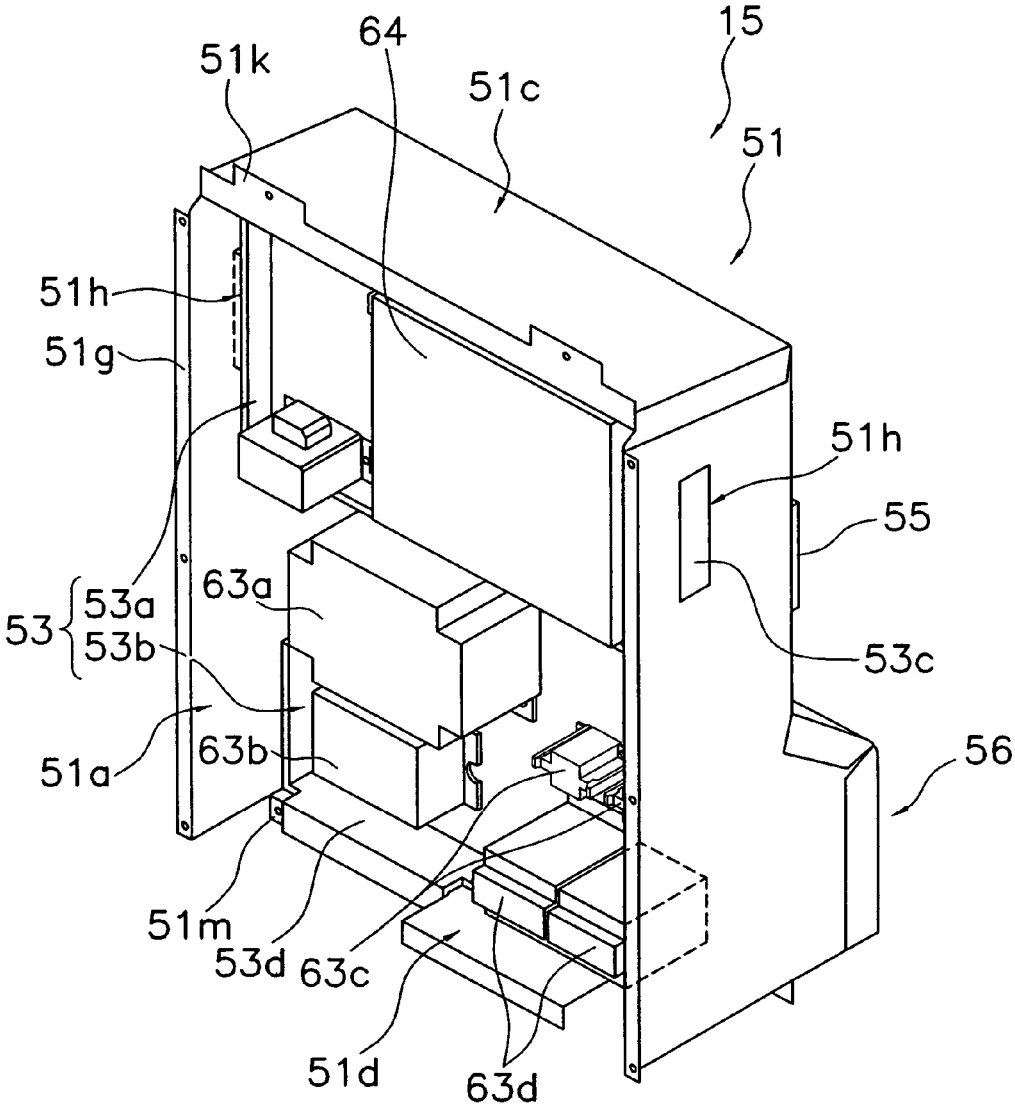
FIG. 8 is a perspective view showing the electrical equipment box with the lid member removed.
Figure 9:
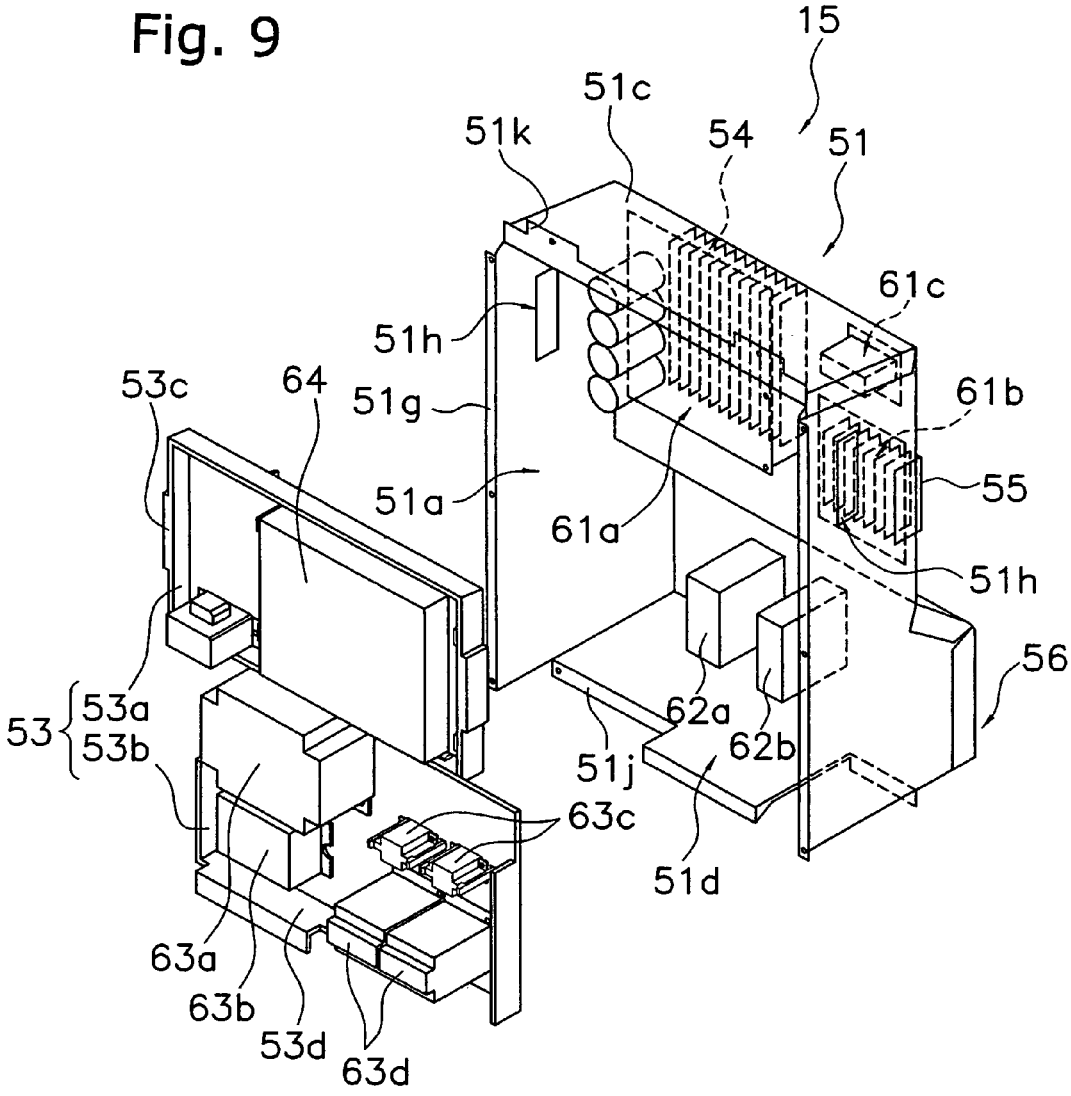
FIG. 9 is an exploded perspective view showing the electrical equipment box with the partition plate removed.

The arrangement of the electric components will now be described using FIGS. 6 to 9. FIG. 8 is a perspective view showing the electrical equipment box 15 with the lid member 52 removed, and FIG. 9 is an exploded perspective view showing the electrical equipment box 15 with the partition plate 53 removed.

The main electrical components housed inside the electrical equipment box 15 include such strong current components as a reactor 61*c* and inverters 61*a*, 61*b* for the compressor 13*a* and the blower fan 14 and such weak current components as noise filters 62*a*, 62*b* for the inverters 61*a*, 61*b*, terminal blocks 63*a* to 63*d*, and a control circuit board 64. The inverters 61*a*, 61*b* and reactors 61*c* are high heat emission components that emit large amounts of heat when the outdoor unit is running and the control circuit board 64 is a low heat emission component that emits a small amount of heat when the outdoor unit is running.

The inverters 61*a*, 61*b* and reactor 61*c* (which are strong current components) are arranged in the back space D in order to promote their cooling when the outdoor unit is in operation. More specifically, the inverter 61*a* is arranged in a position aligned with the cooling fins 54, the inverter 61*b* is arranged in a position aligned with the cooling fins 55, and the reactor 61*c* is arranged above the inverter 61*b*. Meanwhile, the control circuit board 64 (which is a weak current component) is arranged in the front space C and is fastened directly to the partition plate 53 (in this embodiment, the upper partition plate 53*a*). Thus, the strong current components and weak current components are arranged in separate spaces C and D inside the electric equipment box 15.

The terminal blocks 63*a* to 63*d* and the control circuit board 64 (first electrical components) are arranged in the front space C in consideration of their characteristic of being accessed with a high degree of frequency after the outdoor unit 1 is installed. More specifically, the terminal blocks 63*a* to 63*d* are mounted to the lower partition plate 53*b* and the control circuit board 64 is mounted to the upper partition plate 53*a*. The terminal blocks 63*a* to 63*d* and the control circuit board 64 are mounted directly to the partition plates 53*a*, 53*b* because the partition plates 53*a*, 53*b* are made of resin and can be electrically insulated from the box main body 51. Meanwhile, the inverters 61*a*, 61*b*, the reactor 61*c*, and the noise filters 62*a*, 62*b* (second electrical components), which are accessed with a low degree of frequency after the outdoor unit 1 is installed, are arranged in the back space D. However, the minimum required access to the inverters 61*a*, 61*b* arranged in the back space D can be accomplished without removing the partition plate 53 because the terminal connections are visible from the lid member 52 side through the window section 57 (see FIG. 7) provided vertically-between the partition plates 53*a*, 53*b*.

The noise filters 62*a*, 62*b*, which are comparatively long electrical components, are arranged in the lower portion of the back space D, i.e., in the back space D portion of the bulged part 56. Thus, the control circuit board 64, inverters 61*a*, 61*b*, and other board-shaped electrical components are arranged in the upper space (which has a narrower depth dimension) of the box main body 51 and the noise filters 62*a*, 62*b*, terminal blocks 63*a* to 63*d*, and other comparatively long electrical components are arranged in the lower space (more specifically the bulged part 56, which has a wider depth dimension) of the box main body 51. As a result, the electrical equipment box 15 uses space more efficiently.

As described previously regarding the operation of the outdoor unit 1, when the outdoor unit is running, the air drawn into the casing 12 passes through the heat exchanger 13*b* and then flows along such a streamline as to be directed simultaneously inward toward the inner portion of the casing and upward toward the air outlet 22*a*. For example, an air flow similar to streamline F develops at the portion of the electrical equipment box 15 that faces the rear panel 24 (see FIG. 5).

The inverters 61*a*, 61*b* and reactor 61*c* are arranged inside the electrical control box 15 and emit heat constantly when the compressor 13*a* and blower fan 14 are running. However, the inverters 61*a*, 61*b* and reactor 61*c* are sufficiently cooled because they are arranged in the back space D and mounted to the rear face part 51*b* of the box main body 51 and because cooling fins 54, 55 are provided on the rear face part 51*b*. Consequently, it is difficult for the heat to reach the front space C side and the control circuit board 64, which has a low heat resistance, is protected.

Since the bulged part 56 (which corresponds to second box part 15*b*) of the electrical equipment box 15 is provided on lower portion of the electrical equipment box 15, an air flow path is secured in a position close to the blower fan 14 (which is located in an upper portion of the electrical equipment box 15 corresponding to the first box part 15*a*) where the effect on the air flow resistance is large and the increase in air flow resistance is suppressed.

(6) Features of the Outdoor Unit and the Electrical Equipment Box

An outdoor unit 1 and electrical equipment box 15 in accordance with this embodiment have the following features.

(A) In this outdoor unit 1, when the blower fan 14 is driven, air is drawn into the casing 12 through the air inlets 24*a*, 25*a* and, after exchanging heat, the air is blown out through a air outlet 22*a*. Since the electrical equipment box 15 is configured such that the first box part 15*a* is below the blower fan 14, an air flow path is secured in a position close to the blower fan 14 where the effect on the air flow resistance is large and the increase in air flow resistance is suppressed. Meanwhile, since the electrical equipment box 15 is configured such that the second box part 15*b* (which corresponds to the bulged part 56) is positioned below the first box part 15*a*, i.e., far from the blower fan 14, the volume required for housing the various electrical components is secured.

Thus, with the outdoor unit 1 of this embodiment, while volume is secured for the electrical equipment box 15, the air flow path in a position close to the blower fan 14 is widened so that the air flow is not impeded and the increase in air flow resistance inside the outdoor unit can be suppressed. This can contribute to reducing the capacity of the fan motor 14*c* of the blower fan 14 and reducing the noise inside the outdoor unit.

(B) With the outdoor unit 1, the electrical equipment box 15 has a slanted part 15*c* between the second box part 15*b* and the first box part 15*a*. Consequently, in addition to being arranged such that it faces the front panel 23 of the casing 12, the electrical equipment box 15 is configured such that the portion thereof that faces the rear panel 24 is shaped such that it follows the streamline F (the streamline along which the air drawn in from the air inlets 24*a*, 25*a* flows toward the air outlet 22*a*). As a result, the air drawn in through the air inlets 24*a*, 25*a* of the casing 12 can be made to flow smoothly along the streamline F toward the air outlet 22*a* and the increase in air flow resistance inside the outdoor unit 1 can be suppressed.

(C) With the outdoor unit 1, since the electrical equipment box 15 is arranged such that it is offset from the centerline O-P of the front panel 23 of the casing 12, it is easy to secure an air flow path in a position close to the blower fan 14 where the effect on the air flow resistance is large and the increase in air flow resistance is suppressed even further.

(D) In this outdoor unit 1, the electrical equipment box 15 is arranged such that, in a plan view of the casing 12, it overlaps the region where the blower fan 14 conducts blowing work. Even though the electrical equipment box 15 overlaps the region (region T) where the blower fan 14 conducts blowing work, the surface area of the overlapping portion (i.e., portion where surface area Sa overlaps with region T) in the vicinity of the blower fan 14 is reduced because the electrical equipment box 15 is provided with the first box part 15*a* and the second box part 15*b*. In particular, since the width dimension of the electrical equipment box 15 is smaller than the width dimension of a conventional electrical equipment box that is long in the widthwise direction and reaches across almost the entire width of the front panel 23, the amount by which the electric equipment box 15 overlaps with the region in the vicinity of the outside circumference of the blower fan 14, where the effect on the air flow resistance is large, can be reduced. As a result, the increase in air flow resistance inside the outdoor unit 1 can be suppressed effectively.

(E) With the outdoor unit 1, the electrical equipment box 15 can be accessed easily from the front panel 23 of the casing 12 because the electrical equipment box 15 is arranged so as to face the front panel 23 of the casing 12 and the second box part 15*b* bulges outward toward the rear panel 24 of the casing 12. As a result, the outdoor unit 1 can be assembled more easily and worked on more easily onsite.

(F) With the outdoor unit 1, the electrical equipment box 15 is arranged such that it overlaps the region T and configured such that the overlapping surface area ratio (Sc/Sd) is 0.09 or less. As a result, the amount by which the electrical equipment box 15 protrudes into the portion where the blower fan 14 conducts blowing work can be suppressed and the increase in air flow resistance can be suppressed without damaging the effectiveness with which the electrical equipment box 15 is cooled.

(G) With the outdoor unit 1, the ratio of the fan outside diameter D of the blower fan 14 to the length L of a short side of the casing 12 is 0.89 or greater and the ratio of the length L of a short side of the casing 12 to the length W of a long side is 0.80 or greater in order to make the size of the outdoor unit 1 more compact in a plan view of the casing 12. Even in the case of an outdoor unit 1 configured in this manner, by setting the overlapping surface area ratio (Sc/Sd) with which the electrical equipment box 15 overlaps the region T to 0.09 or less, the amount by which the electrical equipment box 15 protrudes into the region T can be suppressed and the increase in air flow resistance can be suppressed without damaging the effectiveness with which the electrical equipment box 15 is cooled.

(H) With the outdoor unit 1, since the electrical equipment box 15 is arranged such that it is offset from the centerline O-P of the front panel 23 of the casing 12 and close to a corner portion of the casing 12, it is easy to secure an air flow path in a position close to the blower fan 14 where the effect on the air flow resistance is large and the increase in air flow resistance is suppressed.

(I) With the electrical equipment box 15 of this embodiment, various sizes and shapes of electrical components can be arranged not only planarly but in a three-dimensional manner because the box main body 51 has a two-layered structure that is divided by the partition plate 53 into a front space C and a back space D in which electrical components can be housed. As a result, wasted space inside the box main body 51 can be eliminated and the electrical equipment box can be made more compact.

Additionally, with this electrical equipment box, the front space C and the back space D can be electrically insulated from each other with ease because the partition plate 53 is made of resin. Furthermore, since the terminal blocks 63*a* to 63*d*, control circuit board 64, and other electrical components can be mounted directly to the partition plate 53 without using insulation packing or the like, this electrical equipment box 15 has a simple structure and contributes to saving space and reducing cost.

(J) With the electrical equipment box 15, electrical components (e.g., the control circuit board 64) that are accessed with a high degree of frequency after the outdoor unit 1 is installed are arranged in the front space C and can therefore be accessed easily by simply removing the lid member 52 (e.g., when accessing control circuit board 64 for the purpose of adjusting settings).

Also, with the electrical equipment box 15, a window section 57 is provided in the partition plate 53 and the minimum required access to the inverters 61*a*, 61*b* arranged in the back space D can be accomplished while leaving the partition plate 53 in its installed state.

(K) With the electrical equipment box 15, it is easier to cool the inverters 61*a*, 61*b*, the reactor 61*c*, and other high heat emission components (which emit larger amounts of heat than the control circuit board 64 and other low heat emission components) using the air flowing inside the casing 12 because the inverters 61*a*, 61*b*, the reactor 61*c*, and other high heat emission components are arranged in the back space D.

Additionally, since cooling fins 54, 55 that project toward the rear panel 24 of the casing 12 are provided on the rear face part 51*b* of the electrical equipment box 15, it is possible to promote cooling of the back space D by the air flowing through the inside of the casing 12.

(L) With the electrical equipment box 15, the bulged part 56 makes it possible to widen a portion of the front space C and the back space D and, thus, makes it possible to install long electrical components, such as the noise filters 62*a*, 62*b*.

(7) Variations

Although the box main body 51 of the electrical equipment box 15 described heretofore is made of sheet metal, it is also acceptable to create an electric equipment box 115 in which the portions corresponding to the upper side face parts 51*e* of the side face parts 51*a* are made out of sheet metal and the portions corresponding to the lower side face parts 51*f* are made out of resin.

Figure 10:
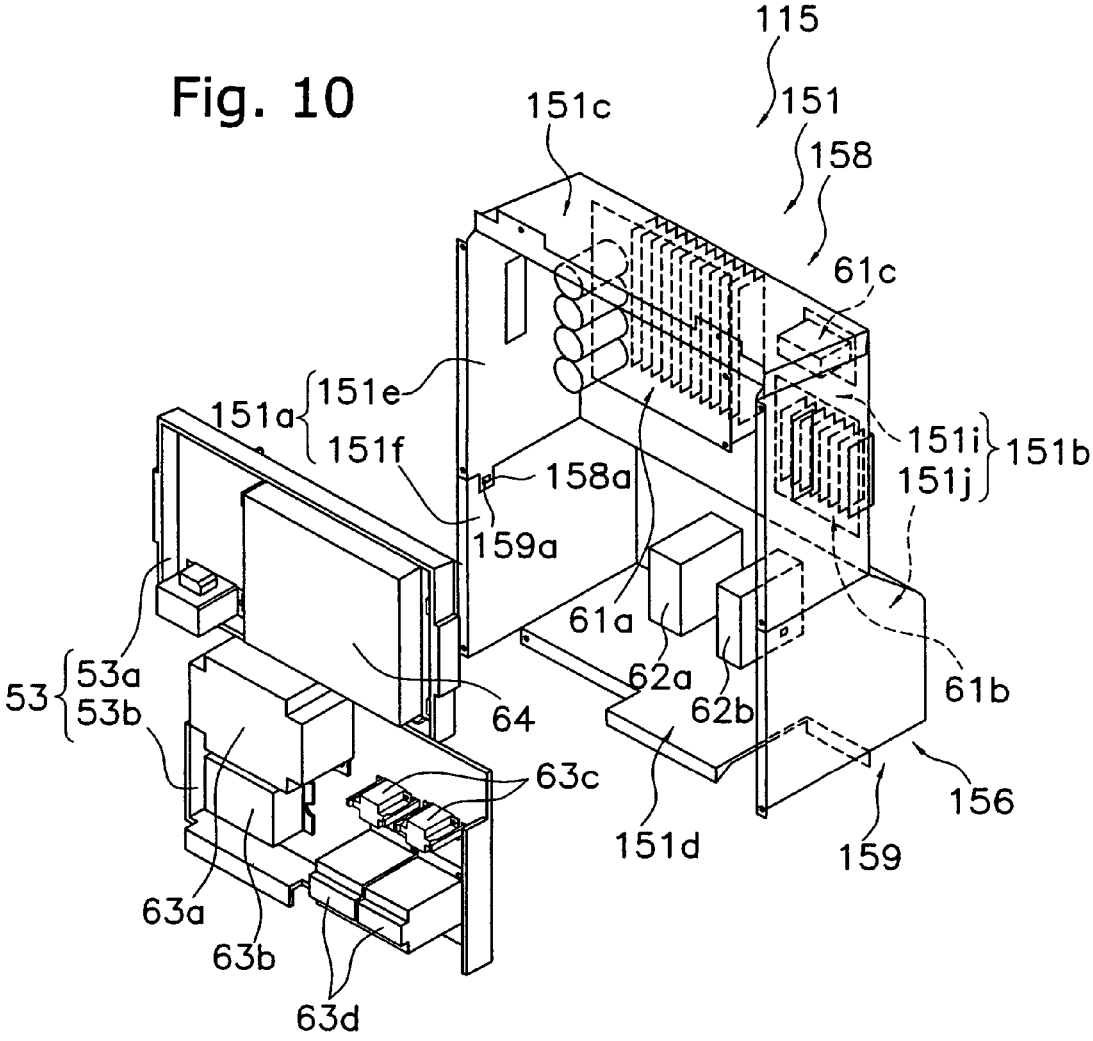
FIG. 10 is equivalent to FIG. 9 and shows an electrical equipment box in accordance with a variation of the first embodiment.

More specifically, an electrical equipment box 115 in accordance with this variation has, as shown in FIG. 10, a box main body 151 comprising a sheet metal box part 158 and a resin box part 159, a lid member 52, and a partition plate 53 (more specifically, an upper partition plate 53*a* and a lower partition plate 53*b*). The sheet metal body part 158 is a sheet metal member that includes the top face part 151*c*, the upper side face parts 151*e* of the side face parts 151*a*, and the upper rear face parts 151*i* of the rear face part 151*b*. The resin body part 159 is a molded resin member that includes the lower side face parts 151*f* of the side face parts 151*a*, and the lower rear face parts 151*j* of the rear face part 151*b*, and the bottom face part 151*d*.

The sheet metal box part 158 and the resin box part 159 are fastened together by means of a plurality of claw parts 158*a* that are provided on a bottom edge of the sheet metal box part 158 and engaging hole parts 159*a* that are provided in a top edge portion of the resin box part 159 and configured such that the claw parts 158*a* can engage therewith.

The electrical equipment box 115, similarly to the electrical equipment box 15 described previously, makes it possible to arrange the inverters 61*a*, 61*b*, the reactor 62, and other high heat emission components in the sheet metal box part 158 and achieves the same effects as the previously described electrical equipment box 15.

Furthermore, with an electrical equipment box 115 according to this variation, it is easier to form the bulged part 156 because the lower portion of the box main body 151 is made of resin. Therefore, the time and effort spent on sheet metal bending work is reduced in comparison with box main bodies made entirely out of sheet metal and the cost of the electrical equipment box 115 can be reduced.

SECOND EMBODIMENT

Figure 11:
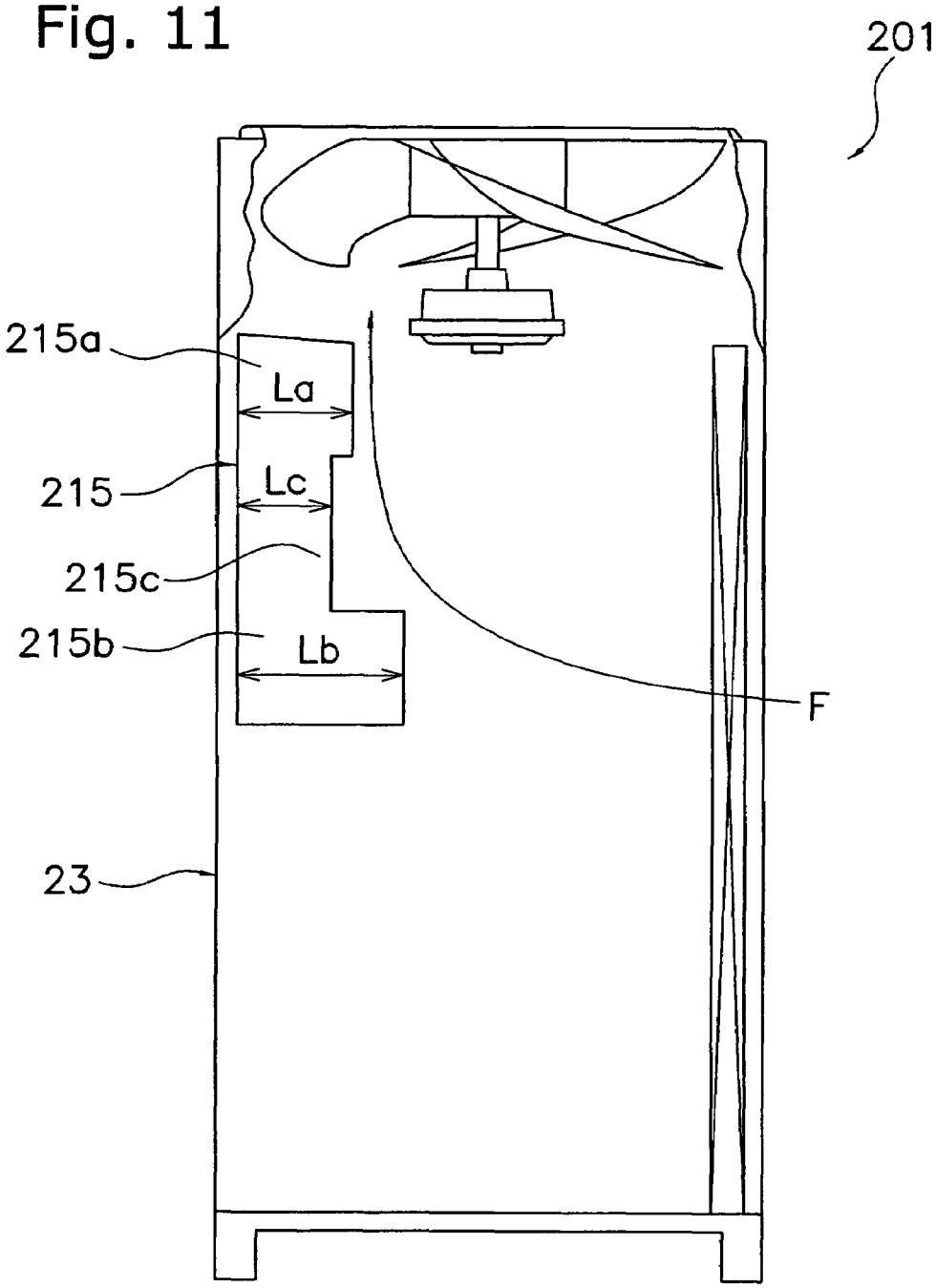
FIG. 11 is equivalent to FIG. 3 and shows an outdoor unit in accordance with a second embodiment.

The electrical equipment box 15 of the first embodiment has a slanted part 15*c* that is provided vertically-between the first box part 15*a* and the second box part 15*b* and is configured such that its surface area in a plan view decreases as one moves from the top end of the second box part 15*b* to the bottom end of the first box part 15*a*. However, it is also acceptable to have an electrical equipment box 215 (for an outdoor unit 201 according to this embodiment) shaped as shown in FIG. 11. More specifically, instead of a slanted part 15*c*, a recessed part 215*c* having a smaller length Lc than the length La of first box part 215*a* is formed vertically-between the first box part 215*a* and the second box part 215*b*.

This electrical equipment box 215, too, maintains a shape that generally follows the streamline F of the air and makes it possible to suppress the increase in air flow resistance inside the outdoor unit 201, similarly to the outdoor unit 1.

THIRD EMBODIMENT

Figure 12:
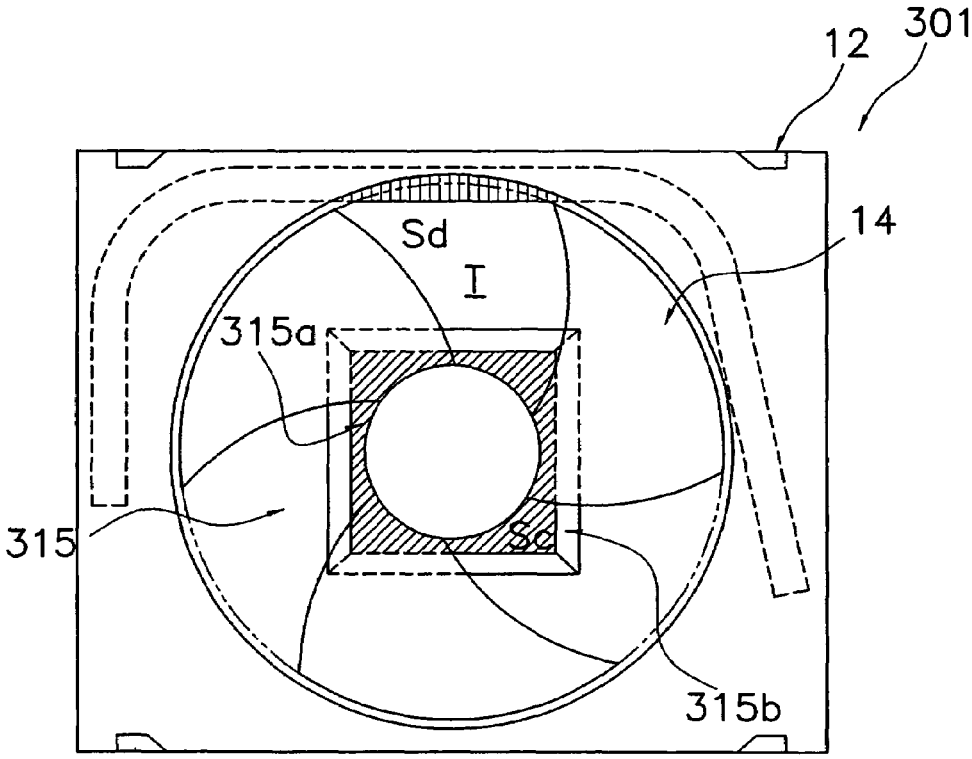
FIG. 12 is equivalent to FIG. 2 and shows an outdoor unit in accordance with a third embodiment.
Figure 13:
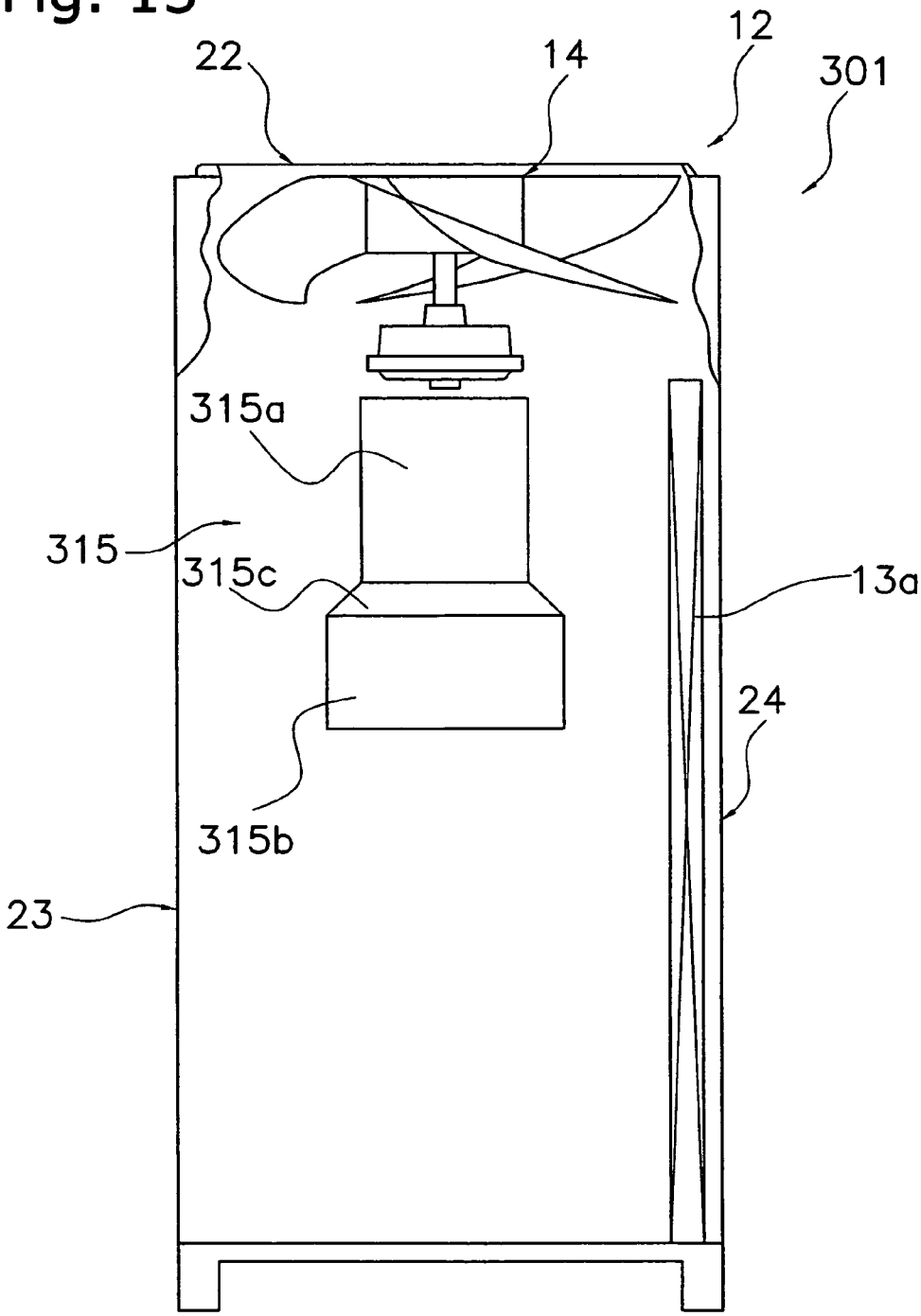
FIG. 13 is equivalent to FIG. 3 and shows an outdoor unit in accordance with a third embodiment.

In the outdoor units 1, 201 of the first and second embodiments, the electrical equipment boxes 15, 115, 215 are arranged such that they face the front panel 23 of the casing 12 and, in a plan view of the casing 12, are offset from the center of the front panel 23 of the casing 12. However, it is also acceptable to have an outdoor unit 301 in which an electrical equipment box 315 shaped as shown in FIGS. 12 and 13 is arranged directly below the hub 14*b* of the blower fan 14.

Similarly to the electrical equipment box 15, the electrical equipment box 315 has a first box part 315*a* positioned closer to the blower fan 14 and a second box part 315*b* located there-below. A slanted part 315*c* is provided vertically-between the first box part 315*a* and the second box part 315*b*.

Thus, even with the electrical equipment box 315, the increase in the air flow resistance inside the outdoor unit 301 can be suppressed similarly to outdoor units 1,201 of the first and second embodiments by setting the surface area ratio (Sc/Sd) of the surface area Sc of the overlapping portion (cross-hatched portion in FIG. 12) to the surface area Sd of the region T to 0.09 or less.

OTHER EMBODIMENTS

Although embodiments of the present invention have been described herein with reference to the drawings, the specific constituent features are not limited to those of these embodiments and variations can be made within a scope that does not deviate from the gist of the invention.

(1) The number of axial fans and the shape of the casing are not limited to those of the embodiments. The present invention can also be applied to an outdoor unit provided with a plurality of axial fans.

(2) Although in the previously described embodiments the electrical equipment box is configured to have a first box part and a second box part, any shape is acceptable so long as the electrical equipment box can ensured of having sufficient volume and the surface area of the overlapping portion can be held equal to or below a prescribed value.

(3) Although in the previously described embodiments the partition plate is divided into two upper and lower sections, it is also acceptable to have a partition plate that is divided into three or more sections or a single partition plate that is not divided.

(4) Although in the previously described embodiments the noise filter is arranged in the back space, it is also acceptable to arrange the noise filter in the front space.

APPLICABILITY TO INDUSTRY

Employing the present invention makes it possible to reduce the size of an outdoor refrigerator unit of the type that draws in air from a lateral face, exchanges heat with the air, and blows the air out of a top face while ensuring that the electrical equipment box has sufficient volume and suppressing the increase in the air flow resistance.

Employing the present invention also makes it possible to suppress the increase in the air flow resistance in a refrigerator outdoor unit of the type that draws in air from a lateral face, exchanges heat with the air, and blows the air out of a top face without disturbing the effectiveness with which the electrical equipment box is cooled.

Employing the present invention also makes it possible to eliminate wasted space inside and reduce the size of the electrical equipment box of a refrigerator outdoor unit of the type that draws in air from a lateral face, exchanges heat with the air, and blows the air out of a top face.

What is claimed is:

1. An outdoor unit of refrigerator of the type that draws in air from a side face, exchanges heat with the air, and blows the air out of a top face, comprising:

a casing;

an axial fan that is provided in an upper portion of the casing and is configured to blow air drawn in from a side face of the casing out through a top face of the casing; and an electrical equipment box that is arranged inside the casing and has a first box part provided below the axial fan and a second box part that is provided below the first box part, and includes the bottom of the electrical equipment box and has a larger surface area in a plan view than the first box part, the electrical equipment box being further provided with a slanted part that is provided vertically-between the second box part and the first box part and is configured such that its surface area in a plan view decreases as one moves from the top end of the second box part to the bottom end of the first box part, the slanted part being disposed under the axial fan.

2. The outdoor unit of refrigerator as recited in claim 1, wherein the casing is generally rectangular in a plan view;

the electrical equipment box is arranged such that it faces one side face of the casing; and the second box part is provided such that it bulges outward beyond the first box part in a direction away from, said one side face of the casing.

3. The outdoor unit of refrigerator as recited in claim 2, wherein the electrical equipment box is arranged such that, in a plan view, it is offset from the center of said one side face of the casing.

4. The outdoor unit of refrigerator as recited in claim 1, wherein the electrical equipment box is arranged such that, in a plan view, it overlaps the region where the axial fan conducts blowing work.

5. An outdoor unit of refrigerator of the type that draws in air from a side face, exchanges heat with the air, and blows the air out of a top face, comprising:

a casing that is generally rectangular in a plan view;

an axial fan that is provided in an upper portion of the casing and is configured to blow air drawn in from a side face of the casing out through a top face of the casing; and an electrical equipment box that is arranged below the axial fan inside the casing such that, in a plan view of the casing, it overlaps the region T where the axial fan conducts blowing work, the electrical equipment box being further arranged such that it faces one side face of the casing, wherein in a plan view of the casing, the ratio Sc/Sd of the overlapping surface area Sc to the blowing surface area Sd is 0.09 or less, where the blowing surface area Sd is the surface area of the region where the axial fan conducts blowing work and the overlapping surface area Sc is the surface area of the portion where the electrical equipment box overlaps the blowing surface area Sd, the electrical equipment box is arranged such that, in a plan view of the casing, it is offset from the center of said one side face of the casing.

6. The outdoor unit of refrigerator as recited in claim 5, wherein in a plan view of the casing, the ratio D/L of the fan outside diameter D of the axial fan to the length L of a short side of the casing is 0.89 or greater.

7. The outdoor unit of refrigerator as recited in claim 6, wherein in a plan view of the casing, the ratio L/W of the length L of a short side of the casing to the length W of a long side of the casing is 0.80 or greater.

8. The outdoor unit of refrigerator as recited claim 5, wherein the electrical equipment box is arranged such that, in a plan view of the casing, it is located in a corner section of the casing.

9. The outdoor unit of refrigerator as recited in claim 5, wherein the electrical equipment box is shaped such that its surface area in a plan view increases as one moves downward away from the axial fan.

10. An electrical equipment box of outdoor unit configured to house electrical components and provided inside the casing of an outdoor refrigerator unit of the type that draws in air from a side face, exchanges heat with the air, and blows the air out through a top face the electrical equipment box comprising:

a box main body provided such that it faces one side face of the casing and has an opening in the side thereof that faces said one side face;

a lid member arranged so as to cover the opening in the box main body; and a partition plate that is provided inside the box main body and serves to partition the space inside the box main body into a front space C on the lid member side and a back space D on the side opposite from the lid member, the partition plate having a window section that links the front space C and back space D together, the box main body has cooling fins that project in a direction away from-said one side face of the casing, the cooling fins projecting from the portion forming the back space of the box main body.

11. The electrical equipment box of outdoor unit as recited in claim 10, wherein the partition plate is made of resin.

12. The electrical equipment box of outdoor unit as recited in claim 10, wherein the electrical components include first electrical components that are accessed with a high degree of frequency after the outdoor unit is installed and second electrical components that are accessed with a low degree of frequency after the outdoor unit is installed; and the first electrical components are arranged in the front space C.

13. The electrical equipment box of outdoor unit as recited in claim 10, wherein the electrical components include low heat emission components that emit small amounts of heat when the outdoor unit is in operation and high heat emission components that emit large amounts of heat when the outdoor unit is in operation; and the high heat emission components are arranged in the back space D.

14. The electrical equipment box of outdoor unit as recited in claim 10, wherein a bulged part that bulges outward in a direction away from said one side face of the casing is provided on a portion of the box main body.

15. The electrical equipment box of outdoor unit as recited in claim 14, wherein the partition plate is provided on a lower portion of the box main body.

16. An electrical equipment box of outdoor unit configured to house electrical components and provided inside the casing of an outdoor refrigerator unit of the type that draws in air from a side face, exchanges heat with the air, and blows the air out through a top face, the electrical equipment box comprising:

a box main body provided such that it faces one side face of the casing and has an opening in the side thereof that faces said one side face;

a lid member arranged so as to cover the opening in the box main body; and a partition plate that is provided inside the box main body and serves to partition the space inside the box main body into a front space C on the lid member side and a back space D on the side opposite from the lid member, wherein a bulged part that bulges outward in a direction away from said one side face of the casing is provided on a portion of the box main body, the bulged part being provided on a lower portion of the box main body;

the box main body comprises a sheet metal box part made of metal and a resin box part made of resin and the sheet metal box part constitutes the upper portion of the box main body; and the resin box part constitutes the lower portion of the box main body and which includes the bulged part.

17. An outdoor unit of refrigerator of the type that draws in air from a side face, exchanges heat with the air and blows the air out of a top face, comprising:

a casing;

an axial fan that is provided in an upper portion of the casing and is configured to blow air drawn in from a side face of the casing out through a top face of the casing; and an electrical equipment box that is arranged inside the casing and has a first box part provided below the axial fan and a second box part that is provided below the first box part and has a larger surface area in a plan view than the first box part, the electrical equipment box is further provided with a slanted part that is provided vertically-between the second box part and the first box part and is configured such that its surface area in a plan view decreases as one moves from the top end of the second box part to the bottom end of the first box part, the slanted part being disposed under the axial fan, wherein the casing is generally rectangular in a plan view;

the electrical equipment box is arranged such that it faces one side face of the casing; and the second box part is provided such that it bulges outward beyond the first box part in a direction away from, said one side face of the casing; and wherein the electrical equipment box is arranged such that, in a plan view, it overlaps the region where the axial fan conducts blowing work.

18. The electrical equipment box of outdoor unit as recited in claim 10, wherein an inverter is arranged in the back space and is arranged by the window section such that terminal connections of the inverter are visible from the lid member side.

* * * * *